US008721044B2

(12) United States Patent
Sato et al.

(10) Patent No.: US 8,721,044 B2
(45) Date of Patent: May 13, 2014

(54) LIQUID DROPLET EJECTION HEAD AND LIQUID DROPLET EJECTION APPARATUS

(71) Applicant: Seiko Epson Corporation, Tokyo (JP)

(72) Inventors: Mitsuru Sato, Suwa (JP); Takatoshi Yamamoto, Suwa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/950,920

(22) Filed: Jul. 25, 2013

(65) Prior Publication Data

US 2013/0307904 A1 Nov. 21, 2013

Related U.S. Application Data

(63) Continuation of application No. 13/104,268, filed on May 10, 2011, now Pat. No. 8,517,519.

(30) Foreign Application Priority Data

May 10, 2010 (JP) ..... 2010-108806

(51) Int. Cl.
*B41J 2/14* (2006.01)
*B41J 2/16* (2006.01)
*B41J 2/045* (2006.01)

(52) U.S. Cl.
USPC ..... 347/47; 347/70

(58) Field of Classification Search
USPC ..... 347/70
See application file for complete search history.

(56) References Cited

U.S. PATENT DOCUMENTS

| | | | |
|---|---|---|---|
| 5,953,023 | A | 9/1999 | Shimomura et al. |
| 6,621,173 | B1 | 9/2003 | Yamakawa et al. |
| 2009/0133820 | A1 | 5/2009 | Sato et al. |
| 2009/0136767 | A1 | 5/2009 | Yamamoto et al. |
| 2009/0147051 | A1 | 6/2009 | Yamamoto |
| 2009/0250168 | A1 | 10/2009 | Sato et al. |
| 2010/0206474 | A1 | 8/2010 | Sato et al. |

FOREIGN PATENT DOCUMENTS

| | | | |
|---|---|---|---|
| JP | 07-164633 | | 6/1995 |
| JP | 2007-062082 | A | 3/2007 |
| JP | 2009-131732 | A | 6/2009 |
| JP | 2009-132749 | A | 6/2009 |
| JP | 2009-143027 | A | 7/2009 |
| JP | 2009-249514 | A | 10/2009 |
| JP | 2010-189518 | A | 9/2010 |

*Primary Examiner* — Lisa M Solomon
(74) *Attorney, Agent, or Firm* — Harness, Dickey & Pierce, P.L.C.

(57) ABSTRACT

An ink jet type recording head includes a substrate, a nozzle plate having nozzles, and a sealing sheet, and the substrate and the nozzle plate are bonded to each other through a bonding film, and the substrate and the sealing sheet are bonded to each other through a bonding film. These bonding films are each obtained by drying and/or curing a liquid material containing an epoxy-modified silicone material. Further, by applying energy to each bonding film, the surface thereof is activated, and therefore, each bonding film exhibits a bonding property. By this bonding property, the substrate is bonded to the nozzle plate and to the sealing sheet.

21 Claims, 10 Drawing Sheets

LIQUID DROPLET EJECTION HEAD AND LIQUID DROPLET EJECTION APPARATUS

CROSS-REFERENCE TO RELATED APPLICATIONS

This is a continuation patent application of U.S. application Ser. No. 13/104,268 filed May 10, 2011 which claims priority to Japanese Patent Application No. 2010-108806, filed May 10, 2010 all of which are expressly incorporated by reference herein in their entireties.

BACKGROUND

1. Technical Field

The present invention relates to a liquid droplet ejection head and a liquid droplet ejection apparatus.

2. Related Art

In a liquid droplet ejection apparatus such as an ink jet printer, a liquid droplet ejection head is provided for ejecting liquid droplets. One known liquid droplet ejection head is provided with an ink chamber (cavity) which stores an ink therein and communicates with a nozzle for ejecting the ink in the form of liquid droplets, and a piezoelectric element for driving which deforms a wall surface of the ink chamber.

In such a liquid droplet ejection head, a part of the ink chamber (a vibration plate) is deformed by expanding and contracting the piezoelectric element for driving. By doing this, the volume of the ink chamber is changed, whereby the liquid droplets of the ink are ejected through the nozzle.

In the meantime, such a liquid droplet ejection head is assembled by bonding a nozzle plate in which the nozzles are formed to a substrate which defines the ink chamber with an adhesive.

However, it is very difficult to precisely control a supply amount of the adhesive when supplying the adhesive between the nozzle plate and the substrate. Therefore, the amount of the adhesive to be supplied cannot be controlled to be uniform, and thus, a distance between the nozzle plate and the substrate becomes uneven. Accordingly, uniform volumes cannot be obtained among a plurality of ink chambers provided in a liquid droplet ejection head, or uniform volumes of ink chambers cannot be obtained among liquid droplet ejection heads. Further, a distance between the liquid droplet ejection head and a printing medium such as printing paper becomes uneven. Further, the adhesive may disadvantageously run out of the bond area. These problems deteriorate the dimensional accuracy of the liquid droplet ejection head, resulting in deteriorating the printing quality of the ink jet printer.

Further, the adhesive is exposed to an ink stored in the ink chamber for a long period of time. When the adhesive is exposed to the ink in this manner, the adhesive is altered or deteriorated by an organic component contained in the ink. Accordingly, the liquid tightness of the ink chamber may be lowered or a component contained in the adhesive may be dissolved in the ink.

On the other hand, a method in which respective members constituting a liquid droplet ejection head are bonded by a solid bonding method is also known.

The solid bonding method is a method in which the respective members are directly bonded to one another without interposing an adhesive layer formed of an adhesive or the like therebetween. Examples of such a solid bonding method include a diffusion bonding method, a silicon direct bonding method, and an anodic bonding method (see, for example, JP-A-2007-62082).

However, the solid bonding method has the following problems: the materials of the members which can be bonded are limited; a heat treatment at a high temperature (e.g., about 700 to 800° C.) is required in a bonding process; an atmosphere in the bonding process is limited to a reduced pressure atmosphere; and it is difficult to partially bond some regions to each other.

SUMMARY

An advantage of some aspects of the invention is to provide a liquid droplet ejection head which has excellent dimensional accuracy and chemical resistance, is capable of printing in high quality for a long period of time, and has high reliability, and a liquid droplet ejection apparatus having high reliability provided with such a liquid droplet ejection head.

A liquid droplet ejection head according to an aspect of the invention includes: a substrate; a nozzle plate which is provided on one surface of the substrate and has nozzles through which an ejection liquid is ejected in the form of liquid droplets; and a sealing plate which is provided on the other surface of the substrate, and an ejection liquid storage chamber which stores the ejection liquid is formed by the substrate, the nozzle plate, and the sealing plate; the substrate is bonded through a bonding film to at least one of the nozzle plate and the sealing plate; and the bonding film bonds the substrate to at least one of the nozzle plate and the sealing plate by a bonding property exhibited in a coating film containing an epoxy-modified silicone material through the application of energy to the coating film.

With such a configuration, a liquid droplet ejection head which has excellent dimensional accuracy and chemical resistance, is capable of printing in high quality for a long period of time, and has high reliability is obtained.

In the liquid droplet ejection head according to the above aspect of the invention, it is preferred that the epoxy-modified silicone material is obtained by an addition reaction between a silicone material and an epoxy resin.

With such a configuration, an epoxy-modified silicone material can be obtained.

In the liquid droplet ejection head according to the above aspect of the invention, it is preferred that the silicone material is composed of polydimethylsiloxane as a main backbone, and the main backbone is branched.

With such a configuration, a bonding film is formed such that the branched chains of the silicone material are entangled with each other, and therefore, the resulting bonding film has a particularly high film strength.

In the liquid droplet ejection head according to the above aspect of the invention, it is preferred that, in the silicone material, at least one methyl group of the polydimethylsiloxane has been substituted by a phenyl group.

With such a configuration, the film strength of the bonding film can be further increased.

In the liquid droplet ejection head according to the above aspect of the invention, it is preferred that the silicone material has a plurality of silanol groups.

With such a configuration, a hydroxy group of the silicone material and an epoxy group of the epoxy resin can be reliably bonded to each other, and an epoxy-modified silicone material to be obtained by an addition reaction between the silicone material and the epoxy resin can be reliably synthesized.

Further, when a bonding film is formed by drying and/or curing a liquid coating film, hydroxy groups contained in silanol groups remaining in the epoxy-modified silicone material are bonded to each other, and therefore, the resulting bonding film has a high film strength.

In the liquid droplet ejection head according to the above aspect of the invention, it is preferred that the epoxy resin has a phenylene group in each molecule.

When a bonding film is formed using an epoxy-modified silicone material containing an epoxy resin having the above structure, the formed bonding film exhibits a particularly high film strength attributed to the incorporation of a phenylene group in the epoxy resin.

In the liquid droplet ejection head according to the above aspect of the invention, it is preferred that the epoxy resin has a linear molecular structure.

With such a configuration, the epoxy resin bonded to the silicone material exists in a state exposed from the silicone material. Therefore, if the epoxy resin has a linear molecular structure, when a bonding film is formed by a liquid coating film, a chance in which the epoxy resins contained in the adjacent epoxy-modified silicone materials come into contact with each other can be increased. As a result, in the epoxy-modified silicone materials, the epoxy resins are entangled with each other, and the epoxy groups contained in the epoxy resins are chemically bonded to each other through ring-opening polymerization, whereby the film strength of the resulting bonding film can be more reliably increased.

In the liquid droplet ejection head according to the above aspect of the invention, it is preferred that a partial region of a bond region to be bonded through the bonding film is fixed with an adhesive in advance, and the bonding film bonds a region other than the partial region of the bond region.

With such a configuration, a positional shift does not occur at the region temporarily fixed in advance, and therefore, an ink droplet ejection head which can be easily and efficiently produced can be obtained.

In the liquid droplet ejection head according to the above aspect of the invention, it is preferred that the bonding film which bonds a region other than the partial region of the bond region is formed by supplying a liquid material containing the epoxy-modified silicone material to the ejection liquid storage chamber formed by the fixing to allow the liquid material to penetrate into an outer portion of the bond region thereby forming a coating film of the liquid material, and then, drying and/or curing the coating film, followed by applying energy to the coating film.

With such a configuration, the liquid material can spontaneously penetrate into an outer portion of the bond region due to the capillary phenomenon, and therefore a coating film of the liquid material can be easily formed. As a result, a portion which comes into contact with the ejection liquid has excellent resistance to the ejection liquid and a portion which does not come into contact with the ejection liquid is temporarily fixed with an adhesive, and thus, a liquid droplet ejection head which can be produced easily and efficiently is obtained.

In the liquid droplet ejection head according to the above aspect of the invention, it is preferred that the bonding film has an average thickness of 10 to 10000 nm.

With such a configuration, the bonding film which can more strongly bond the respective members including the substrate, the nozzle plate, and the sealing plate while preventing a significant deterioration of the dimensional accuracy of a bonded body formed by bonding the respective members is obtained. Further, with such a configuration, the bonding film has elasticity to some extent, and therefore, when the respective members are bonded through this bonding film, the bonding film functions such that it encompasses a foreign substance therein, whereby the occurrence of peeling in the bond interface can be prevented.

In the liquid droplet ejection head according to the above aspect of the invention, it is preferred that at least a portion of the substrate, the nozzle plate, or the sealing plate, which comes into contact with the bonding film, is mainly made of a silicon material, a metal material, or a glass material.

The surface of each of the respective members including the substrate, the nozzle plate, and the sealing plate each made of such a material is covered with an oxide film, and to the surface of this oxide film, a hydroxy group having a relatively high activity is bonded.

Therefore, the bonding strength between each of the respective members and the bonding film can be increased even if the respective members are not subjected to a surface treatment.

In the liquid droplet ejection head according to the above aspect of the invention, it is preferred that a surface of the substrate, the nozzle plate, or the sealing plate, which comes into contact with the bonding film, is subjected to a surface treatment for increasing an adhesive property with the bonding film in advance.

With such a configuration, the bonding strength between the bonding film and each of the respective members including the substrate, the nozzle plate, and the sealing plate can be further increased.

In the liquid droplet ejection head according to the above aspect of the invention, it is preferred that the surface treatment is a plasma treatment or an ultraviolet irradiation treatment.

With such a configuration, a surface of each of the respective members can be particularly made optimal for forming the bonding film.

In the liquid droplet ejection head according to an aspect of the invention, it is preferred that the application of energy is performed by at least one of a method of irradiating the bonding film with an energy ray and a method of bringing the bonding film into contact with plasma.

With such a configuration, energy can be applied to the bonding film relatively easily and efficiently.

In the liquid droplet ejection head according to an aspect of the invention, it is preferred that the energy ray is an ultraviolet ray having a wavelength of 126 to 300 nm.

With such a configuration, an amount of energy to be applied is made optimal, and therefore, the molecular bonds in the vicinity of the surface of the bonding film can be selectively broken while preventing excessive breakage of the molecular bonds constituting the backbone in the bonding film. Accordingly, it is possible to reliably allow the bonding film to exhibit an adhesive property while preventing the deterioration of other properties (such as mechanical properties and chemical properties) of the bonding film.

In the liquid droplet ejection head according to the above aspect of the invention, it is preferred that the application of energy is performed in an air atmosphere.

With such a configuration, the labor time and cost for controlling the atmosphere can be saved, and energy can be more easily applied.

In the liquid droplet ejection head according to the above aspect of the invention, it is preferred that after bonding the substrate to at least one of the nozzle plate and the sealing plate through the bonding film, a treatment for increasing the bonding strength is further performed for the bonding film.

With such a configuration, the bonding strength of the bonded body formed by bonding the respective members including the substrate, the nozzle plate, and the sealing plate can be further increased.

In the liquid droplet ejection head according to the above aspect of the invention, it is preferred that the treatment for increasing the bonding strength is performed by at least one of a method of heating the bonding film and a method of applying a compressive force to the bonding film.

With such a configuration, the bonding strength of the bonded body formed by bonding the respective members including the substrate, the nozzle plate, and the sealing plate can be further increased easily.

In the liquid droplet ejection head according to the above aspect of the invention, it is preferred that the sealing plate is formed of a laminated body having a plurality of layers laminated on one another, and bonding is achieved through a bonding film similar to the bonding film between at least one pair of adjacent layers among the layers in the laminated body.

With such a configuration, the dimensional accuracy of the laminated body is increased, whereby the dimensional accuracy of the liquid droplet ejection head can be increased.

It is preferred that the liquid droplet ejection head according to the above aspect of the invention further includes a vibration unit which is provided on an opposite side of the sealing plate from the substrate and vibrates the sealing plate, and the sealing plate and the vibration unit are bonded to each other through a bonding film similar to the bonding film.

With such a configuration, strain generated by the vibration unit can be reliably converted to deformation of the sealing plate, and can also be reliably converted to a change in the volume of the ejection liquid storage chamber.

In the liquid droplet ejection head according to the above aspect of the invention, it is preferred that the vibration unit is formed of a piezoelectric element.

With such a configuration, a degree of deflection generated in the sealing plate can be easily controlled. Accordingly, the size of the liquid droplet of the ejection liquid can be easily controlled.

It is preferred that the liquid droplet ejection head according to the above aspect of the invention further includes a case head which is provided on an opposite side of the sealing plate from the substrate, and the sealing plate and the case head are bonded to each other through a bonding film similar to the bonding film.

With such a configuration, the adhesive property between the sealing plate and the case head is increased. As a result, the sealing plate is reliably supported by the case head, and therefore, twist, warpage, or the like of the sealing plate, the substrate, and the nozzle plate can be reliably prevented.

A liquid droplet ejection apparatus according to another aspect of the invention includes the liquid droplet ejection head according to the above aspect of the invention.

With such a configuration, a liquid droplet ejection apparatus having high reliability is obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid droplet ejection head and a liquid droplet ejection apparatus according to the invention will be described in detail with reference to preferred embodiments shown in the accompanying drawings.

Ink jet Type Recording Head

First Embodiment

First, a description will be made of a first embodiment in which a liquid droplet ejection head according to the invention is applied to an ink jet type recording head.

Figure 1:
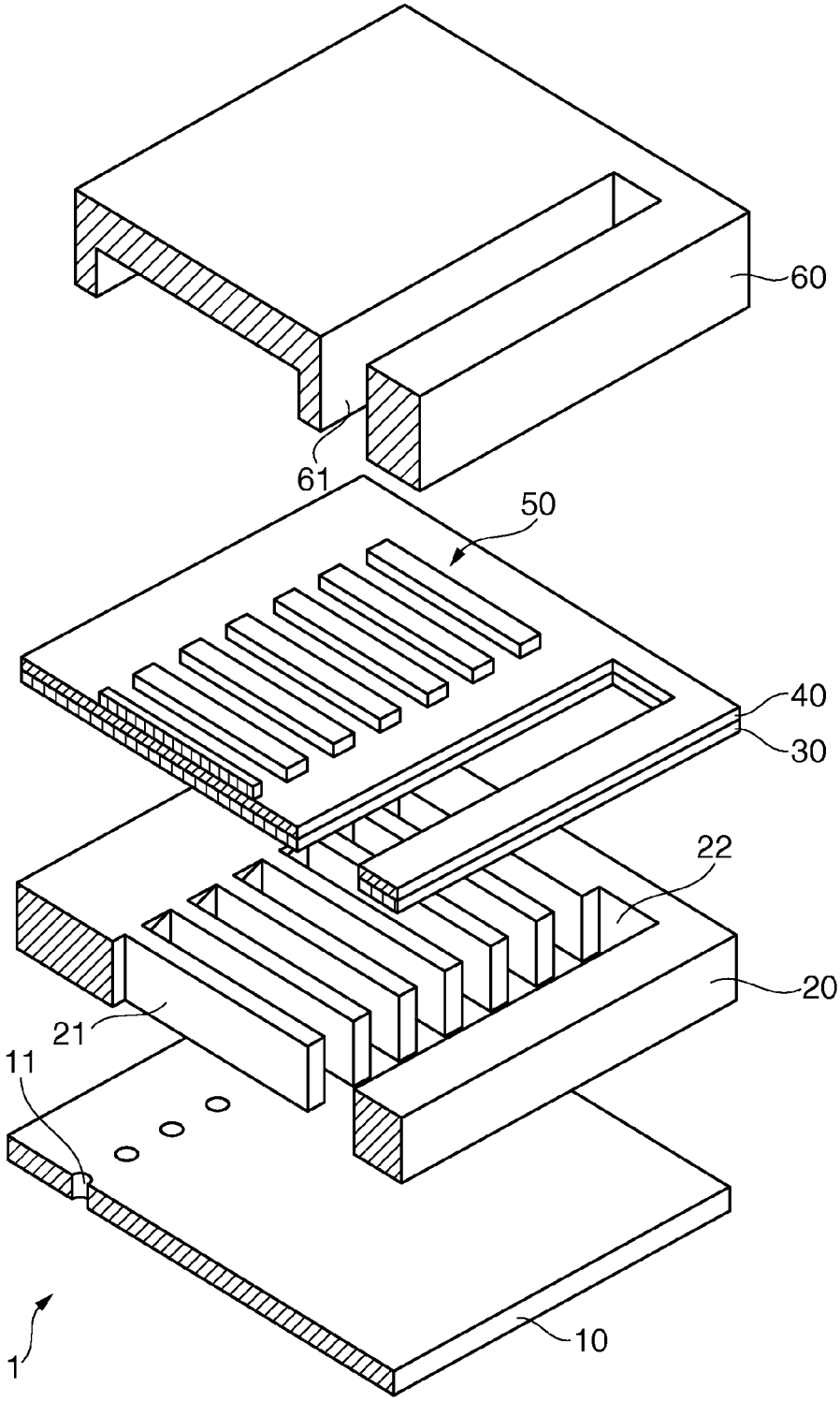
FIG. 1 is an exploded perspective view showing a first embodiment in which a liquid droplet ejection head according to the invention is applied to an ink jet type recording head.
Figure 2:
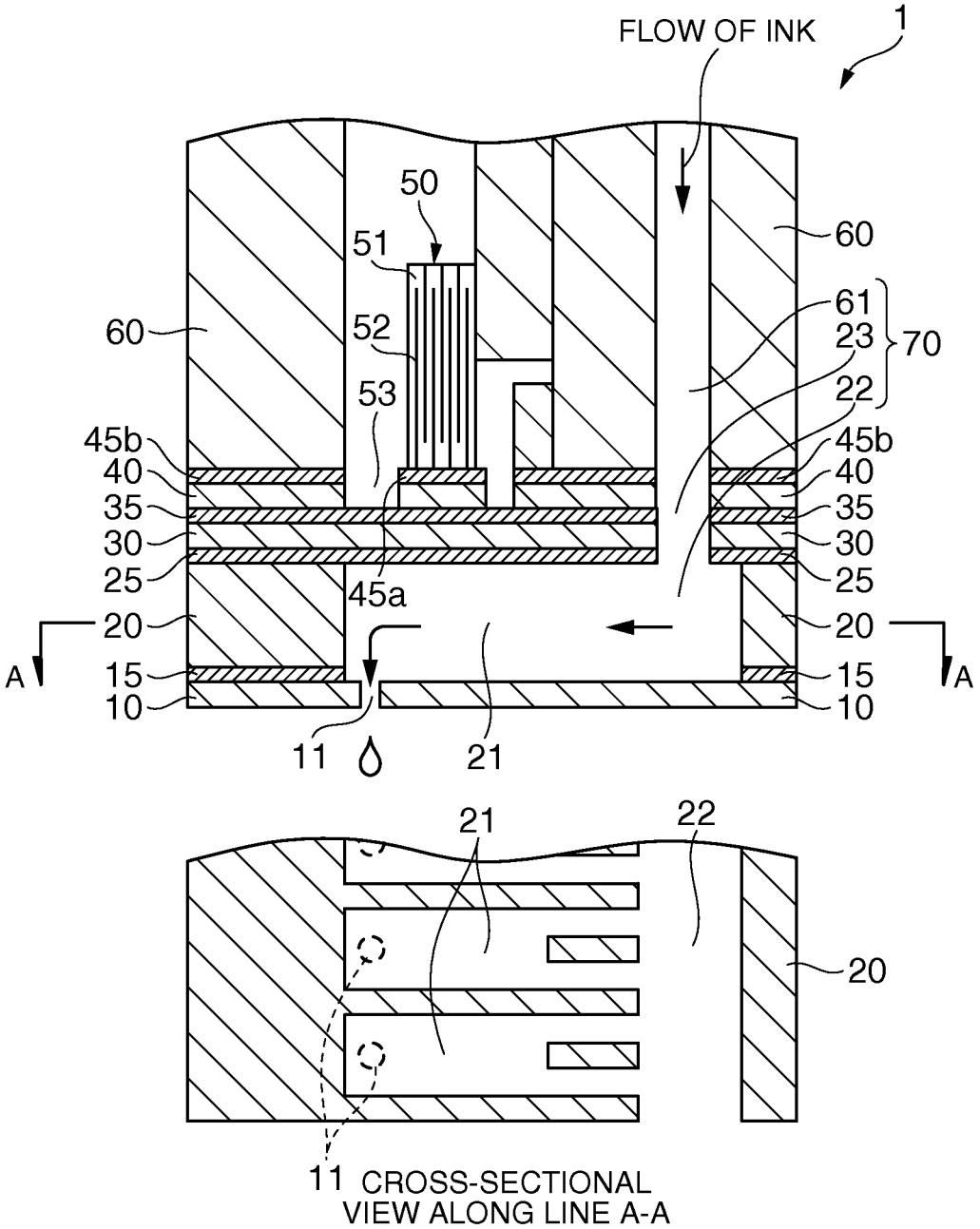
FIG. 2 is a cross-sectional view of the ink jet type recording head shown in FIG. 1.
Figure 3:
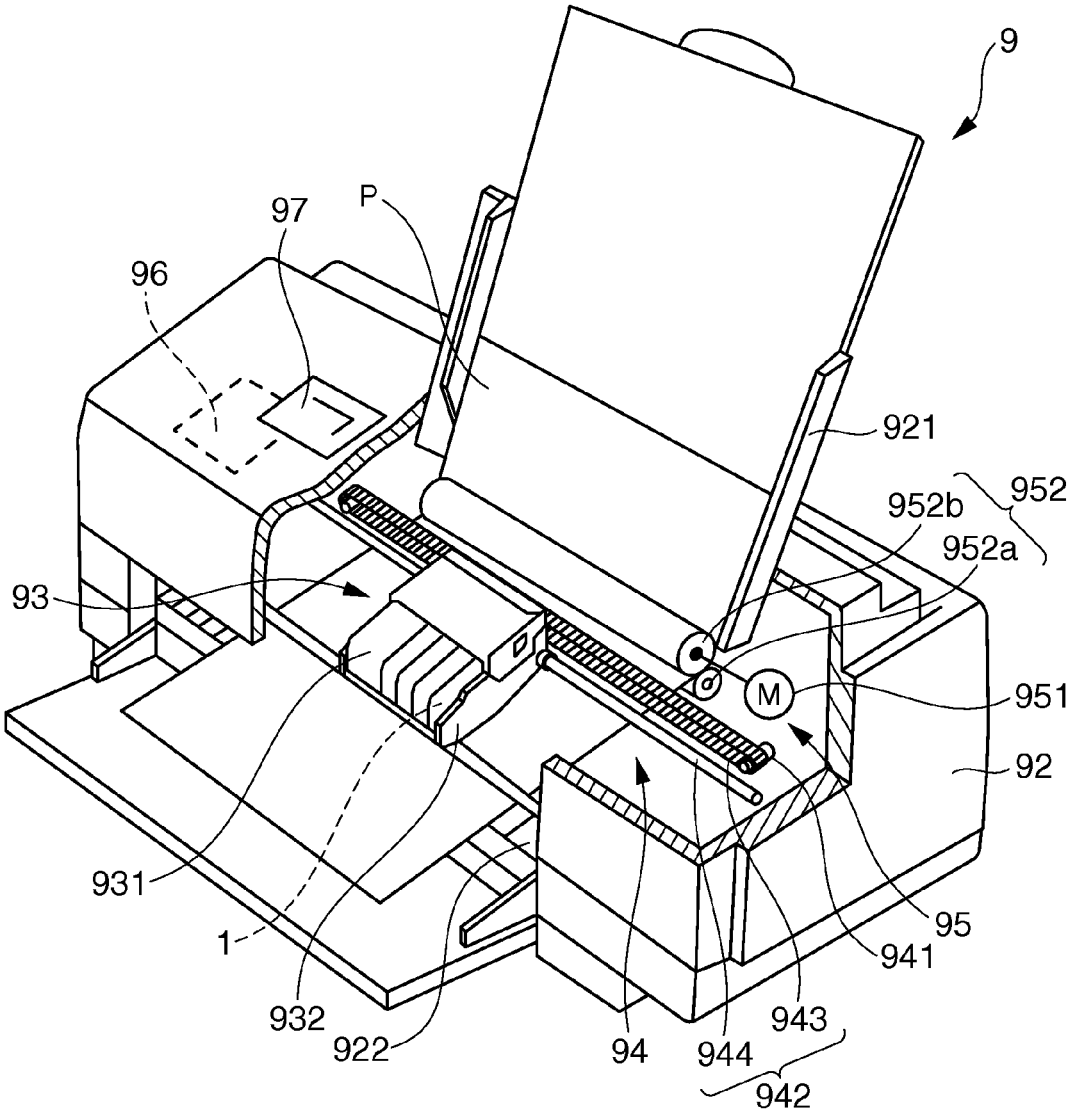
FIG. 3 is a schematic view showing one embodiment of an ink jet printer provided with the ink jet type recording head shown in FIG. 1.

FIG. 1 is an exploded perspective view showing a first embodiment in which a liquid droplet ejection head according to the invention is applied to an ink jet type recording head; FIG. 2 is a cross-sectional view of the ink jet type recording head shown in FIG. 1; and FIG. 3 is a schematic view showing one embodiment of an ink jet printer including the ink jet type recording head shown in FIG. 1. In the following description, the upper side of each of FIGS. 1 and 2 is referred to as "upper" and the lower side thereof is referred to as "lower" for convenience of explanation.

An ink jet type recording head 1 (hereinafter, simply referred to as "head 1") shown in FIG. 1 is mounted on an ink jet printer (the liquid droplet ejection apparatus according to the invention) 9 as shown in FIG. 3.

The ink jet printer 9 shown in FIG. 3 is provided with a main body 92 that has a tray 921 for holding recording paper P at an upper rear part thereof, a paper discharging port 922 for discharging the recording paper P at a lower front part thereof, and an operation panel 97 on an upper surface thereof.

The operation panel 97 is provided with a display section (not shown) which is formed of, for example, a liquid crystal display, an organic EL display, an LED lamp, or the like and displays an error message or the like, and an operation section (not shown) which is formed of various types of switches and the like.

Further, in the inside of the main body 92, a printing device (printing unit) 94 having a reciprocating head unit 93, a paper feeding device (paper feeding unit) 95 for feeding the recording paper P into the printing device 94 one by one and a controlling section (controlling unit) 96 for controlling the printing device 94 and the paper feeding device 95 are mainly provided.

Under control of the controlling section 96, the paper feeding device 95 feeds the recording paper P one by one in an intermittent manner. The recording paper P passes near a lower part of the head unit 93. At this time, the head unit 93 makes reciprocating movement in a direction substantially perpendicular to a feeding direction of the recording paper P, whereby printing is performed on the recording paper P. In other words, the reciprocating movement of the head unit 93 and the intermittent feeding of the recording paper P respectively act as primary scanning and secondary scanning of a printing operation, whereby an ink jet type printing operation is performed.

The printing device 94 is provided with the head unit 93, a carriage motor 941 serving as a driving power source of the head unit 93, and a reciprocating mechanism 942 for causing the head unit 93 to reciprocate in response to the rotation of the carriage motor 941.

The head unit 93 is provided with the head 1 having a plurality of nozzles 11 at a lower part thereof, an ink cartridge 931 for supplying an ink to the head 1, and a carriage 932 which carries the head 1 and the ink cartridge 931.

By using four color (yellow, cyan, magenta, and black) ink cartridges as the ink cartridge 931, full color printing can be performed.

The reciprocating mechanism 942 includes a carriage guide shaft 943 having both ends supported by a frame (not shown) and a timing belt 944 extending in parallel to the carriage guide shaft 943.

The carriage 932 is reciprocatably supported by the carriage guide shaft 943 and fixed to a part of the timing belt 944.

When the timing belt 944 is caused to run forward and backward via a pulley by the operation of the carriage motor 941, the head unit 93 makes reciprocating movement along the carriage guide shaft 943. During this reciprocating movement, an appropriate amount of the ink is ejected from the head 1, whereby printing is performed on the recording paper P.

The paper feeding device 95 includes a paper feeding motor 951 serving as a driving power source thereof and paper feeding rollers 952 rotated by the operation of the paper feeding motor 951.

The paper feeding rollers 952 include a driven roller 952*a* and a driving roller 952*b*, both of which face toward each other in a vertical direction with a paper feeding path of the recording paper P (i.e., the recording paper P) sandwiched therebetween. The driving roller 952*b* is connected to the paper feeding motor 951. Thus, the paper feeding rollers 952 can feed a plurality of sheets of the recording paper P which are held in the tray 921 toward the printing device 94 one by one. Incidentally, it may be possible to employ a structure in which a paper feeding cassette containing the recording paper P can be removably mounted in place of the tray 921.

The controlling section 96 controls the printing device 94, the paper feeding device 95, and the like based on printing data input from a host computer such as a personal computer or a digital camera to perform printing.

Although not shown in the drawings, the controlling section 96 is mainly provided with a memory for storing a control program for controlling the respective members and the like, a driving circuit for driving the printing device 94 (carriage motor 941), a driving circuit for driving the paper feeding device 95 (paper feeding motor 951), a communication circuit for receiving the printing data from the host computer, and a CPU which is electrically connected to these members and performs various types of controls at the respective members.

Further, to the CPU, various types of sensors capable of detecting, for example, an amount of ink remaining in the ink cartridge 931, a position of the head unit 93, and the like are electrically connected, respectively.

The controlling section 96 receives the printing data through the communication circuit and stores the data in the memory. The CPU processes these printing data and outputs a driving signal to each driving circuit based on the data thus processed and data input from the various types of sensors. In response to this driving signal, the printing device 94 and the paper feeding device 95 come into operation, whereby printing is performed on the recording paper P.

Hereinafter, the head 1 will be described in detail with reference to FIGS. 1 and 2.

As shown in FIGS. 1 and 2, the head 1 includes a nozzle plate 10, an ejection liquid storage chamber forming substrate (substrate) 20, a sealing sheet 30, a vibration plate 40 provided on the sealing sheet 30, a piezoelectric element (vibration unit) 50 provided on the vibration plate 40, and a case head 60. Further, in this embodiment, a sealing plate is formed of a laminated body of the sealing sheet 30 and the vibration plate 40. Incidentally, the head 1 forms a piezo jet type head.

In the ejection liquid storage chamber forming substrate 20 (hereinafter, referred to as a "substrate 20" in an abbreviated form), a plurality of ejection liquid storage chambers (pressure chambers) 21 which store the ink therein and an ejection liquid supply chamber 22 which communicates with each of the ejection liquid storage chambers 21 and supplies the ink to each of the ejection liquid storage chambers 21 are formed.

As shown in FIGS. 1 and 2, each of the ejection liquid storage chambers 21 and the ejection liquid supply chamber 22 has a substantially rectangular shape in a plan view, and a width (a short side) of each of the ejection liquid storage chambers 21 is smaller than a width (a short side) of the ejection liquid supply chamber 22.

Further, each of the ejection liquid storage chambers is disposed substantially perpendicular to the ejection liquid supply chamber 22, that is, the respective ejection liquid storage chambers 21 and the ejection liquid supply chamber 22 form a comb shape as a whole in a plan view.

Incidentally, the ejection liquid supply chamber 22 may have, for example, a trapezoidal shape, a triangular shape, or a capsule shape in a plan view instead of the rectangular shape as in this embodiment.

Examples of a constituent material of the substrate 20 include silicon materials such as monocrystalline silicon, multicrystalline silicon, and amorphous silicon; metal materials such as stainless steel, titanium, and aluminum; glass materials such as quartz glass, silicate glass (quartz glass), alkaline silicate glass, soda-lime glass, potash lime glass, lead (alkaline) glass, barium glass, and borosilicate glass; ceramic materials such as alumina, zirconia, ferrite, silicon nitride, aluminum nitride, boron nitride, titanium nitride, silicon carbide, boron carbide, titanium carbide, and tungsten carbide; carbon materials such as graphite; and resin materials such as polyolefins (such as polyethylene, polypropylene, ethylene-propylene copolymers, and ethylene-vinyl acetate copolymers (EVA)), cyclic polyolefins, modified polyolefins, polyvinyl chloride, polyvinylidene chloride, polystyrene, polyamide, polyimide, polyamide-imide, polycarbonate, poly-(4-methylpentene-1), ionomers, acrylic resins, polymethyl methacrylate, acrylonitrile-butadiene-styrene copolymers (ABS resins), acrylonitrile-styrene copolymers (AS resins), butadiene-styrene copolymers, polyoxymethylene, polyvinyl alcohol (PVA), ethylene-vinyl alcohol copolymers (EVOH), polyesters (such as polyethylene terephthalate (PET), polyethylene naphthalate, polybutylene terephthalate (PBT), and polycyclohexane terephthalate (PCT)), polyether, polyether ketone (PEK), polyether ether ketone (PEEK), polyetherimide, polyacetal (POM), polyphenylene oxide, modified polyphenylene oxide, modified polyphenylene ether resins (PBO), polysulfone, polyethersulfone, polyphenylene sulfide (PPS), polyarylate, aromatic polyesters (liquid crystalline polymers), polytetrafluoroethylene, polyvinylidene fluoride, other fluorine-based resins, styrene-based, polyolefin-based, polyvinyl chloride-based, polyurethane-based, polyester-based, polyamide-based, polybutadiene-based, trans-polyisoprene-based, fluororubber-based, and chlorinated polyethylene-based thermoplastic elastomers, epoxy resins, phenol resins, urea resins, melamine resins, aramid resins, unsaturated polyesters, silicone resins, polyurethane, or copolymers, blended materials, and polymer alloys that mainly contain any of the above materials. These materials may be used alone, or a complex material or the like obtained by mixing two or more of these materials may be used.

Further, a material obtained by subjecting a material as described above to a treatment such as an oxidation treatment (forming an oxide film), a plating treatment, a passivation treatment, or a nitriding treatment may be used.

Among these materials, the constituent material of the substrate 20 is preferably a silicon material or stainless steel. Such a material has excellent chemical resistance, and therefore, even if the material is exposed to the ink for a long period of time, alteration or deterioration of the substrate 20 can be reliably prevented. Further, such a material has excellent processability, and therefore, the substrate 20 having high dimensional accuracy is obtained. Accordingly, the volume accuracy of the ejection liquid storage chambers 21 and the ejection liquid supply chamber 22 is increased, whereby a head 1 that can perform high quality printing is obtained.

Further, the ejection liquid supply chamber 22 communicates with an ejection liquid supply path 61 which is provided in the case head 60 described later and constitutes a part of a reservoir 70 serving as an ink chamber which is shared by the plurality of the ejection liquid storage chambers 21 and supplies the ink to the respective chambers 21.

Further, a hydrophilic treatment may be performed for the inner surfaces of the ejection liquid storage chambers 21 and the ejection liquid supply chamber 22 in advance. By doing this, incorporation of bubbles in the ink stored in the ejection liquid storage chambers 21 and the ejection liquid supply chamber 22 can be prevented.

The nozzle plate 10 is bonded (adhered) to a lower surface (a surface on an opposite side from the sealing sheet 30) of the substrate 20 through a bonding film 15.

The liquid droplet ejection head according to the invention has a characteristic in this bonding film 15 and a method of bonding the substrate 20 to the nozzle plate 10 using the bonding film 15.

This bonding film 15 contains an epoxy-modified silicone material described later.

When energy is applied to this bonding film 15, breakage of a part of molecular bonds (such as a Si—$CH_3$ bond or a Si-Phe bond) in the vicinity of a surface (a surface on a side of the nozzle plate 10) of the bonding film 15 occurs to activate the surface, whereby the bonding film 15 exhibits a bonding property. Due to this bonding property, the substrate 20 and the nozzle plate 10 are bonded to each other.

Incidentally, this bonding film 15 will be described in detail later.

In the nozzle plate 10, the nozzles 11 are formed (perforated) such that the nozzles correspond to the respective ejection liquid storage chambers 21. The ink stored in each of the ejection liquid storage chambers 21 is pushed out of the chamber through each of the nozzles 11, and thus, the ink can be ejected in the form of liquid droplets.

Further, the nozzle plate 10 constitutes the lower surfaces of inner walls of the respective ejection liquid storage chambers 21 and the ejection liquid supply chamber 22. That is, the nozzle plate 10, the substrate 20, and the sealing sheet 30 define (form) the respective ejection liquid storage chambers 21 and the ejection liquid supply chamber 22.

Examples of a constituent material of the nozzle plate 10 include silicon materials, metal materials, glass materials, ceramic materials, carbon materials, and resin materials as described above. These materials may be used alone, or a complex material or the like obtained by mixing two or more of these materials may be used.

Among these materials, the constituent material of the nozzle plate 10 is preferably a silicon material or stainless steel. Such a material has excellent chemical resistance. Therefore, even if the nozzle plate 10 is exposed to the ink for a long period of time, alteration or deterioration of the nozzle plate 10 can be reliably prevented. Further, such a material has excellent processability, and therefore, the nozzle plate 10 having high dimensional accuracy is obtained. Accordingly, a head 1 having high reliability is obtained.

Incidentally, the constituent material of the nozzle plate 10 preferably has a linear expansion coefficient at 300° C. or lower of about 2.5 to $4.5\times10^{-6}$/° C.

The thickness of the nozzle plate 10 is not particularly limited, however, it is preferably from about 0.01 to 1 mm.

Further, on a lower surface of the nozzle plate 10, a liquid repellent film (not shown) is provided as needed. By doing this, ejection of ink droplets from the nozzle hole in an unintended direction can be prevented.

Examples of a constituent material of such a liquid repellent film include a coupling agent having a functional group exhibiting liquid repellency and a resin material having liquid repellency.

As the coupling agent, for example, a silane-based coupling agent, a titanium-based coupling agent, an aluminum-based coupling agent, a zirconium-based coupling agent, an organophosphate-based coupling agent, a silyl-peroxide-based coupling agent, or the like can be used.

Examples of the functional group exhibiting liquid repellency include a fluoroalkyl group, an alkyl group, a vinyl group, an epoxy group, a styryl group, and a methacryloxy group.

Examples of the resin material having liquid repellency include fluorine-based resins such as polytetrafluoroethylene (PTFE), tetrafluoroethylene-perfluoroalkyl vinyl ether copolymers (PFA), ethylene-tetrafluoroethylene copolymers (ETFE), perfluoroethylene-propene copolymers (FEP), and ethylene-chlorotrifluoroethylene copolymers (ECTFE).

Further, the sealing sheet 30 is bonded (adhered) to an upper surface of the substrate 20 through a bonding film 25.

Further, the sealing sheet 30 constitutes the upper surfaces of inner walls of the respective ejection liquid storage chambers 21 and the ejection liquid supply chamber 22. That is, the sealing sheet 30, the substrate 20, and the nozzle plate 10 define the respective ejection liquid storage chambers 21 and the ejection liquid supply chamber 22. By reliably bonding the sealing sheet 30 to the substrate 20, the liquid tightness of the respective ejection liquid storage chambers 21 and the ejection liquid supply chamber 22 is secured.

Examples of a constituent material of the sealing sheet 30 include silicon materials, metal materials, glass materials, ceramic materials, carbon materials, and resin materials as described above. These materials may be used alone, or a complex material or the like obtained by mixing two or more of these materials may be used.

Among these materials, the constituent material of the sealing sheet 30 is preferably a resin material such as polyphenylene sulfide (PPS) or an aramid resin, a silicon material, or stainless steel. Such a material has excellent chemical resistance. Therefore, even if the sealing sheet 30 is exposed to the ink for a long period of time, alteration or deterioration of the sealing sheet 30 can be reliably prevented. Accordingly, the ink can be stored for a long period of time in the ejection liquid storage chambers 21 and the ejection liquid supply chamber 22.

The bonding film 25 through which such a sealing sheet 30 and the substrate 20 are bonded to each other has the same bonding function (bonding property) as that of the bonding film 15 described above.

That is, the bonding film 25 contains an epoxy-modified silicone material in the same manner as the bonding film 15.

When energy is applied to this bonding film 25, breakage of a part of molecular bonds (such as a Si—$CH_3$ bond or a Si-Phe bond) in the vicinity of a surface (a surface on a side of the sealing sheet 30) of the bonding film 25 occurs to activate the surface, whereby the bonding film 25 exhibits a bonding property. Due to this bonding property, the substrate 20 and the sealing sheet 30 are bonded to each other.

Incidentally, the bonding film 25 will be described in detail later as well as the bonding film 15.

The vibration plate 40 is bonded (adhered) to an upper surface of the sealing sheet 30 through a bonding film 35.

Examples of a constituent material of the vibration plate 40 include silicon materials, metal materials, glass materials, ceramic materials, carbon materials, and resin materials as described above. These materials may be used alone, or a complex material or the like obtained by mixing two or more of these materials may be used. By reliably bonding the vibration plate 40 to the sealing sheet 30, strain occurring in the piezoelectric element 50 is reliably converted to deformation of the sealing sheet 30, in other words, to a change in the volume of each of the ejection liquid storage chambers 21.

Among these materials, the constituent material of the vibration plate 40 is preferably a silicon material or stainless steel. Such a material can be elastically deformed at a high speed. Therefore, by deforming the vibration plate 40 by the piezoelectric element 50, the volume of the ejection liquid storage chamber 21 can be changed at a high speed. As a result, the ink can be ejected with high accuracy.

The bonding film 35 through which such a vibration plate 40 and the sealing sheet 30 are bonded to each other may be formed of any material as long as the sealing sheet 30 and the vibration plate 40 can be bonded or adhered to each other through the bonding film 35. A constituent material of the bonding film 35 is appropriately selected depending on each of the constituent materials of the sealing sheet 30 and the vibration plate 40, however, examples thereof include adhesives such as an epoxy-based adhesive, a silicone-based adhesive, and a urethane-based adhesive; soldering materials; and brazing materials.

The bonding film 35 is not necessarily provided and may be omitted. In this case, bonding (adhering) between the sealing sheet 30 and the vibration plate 40 can be achieved by fusion (welding) or by a direct bonding method such as solid bonding (such as silicon direct bonding or anodic bonding).

In this embodiment, however, the bonding film 35 has the same bonding function (bonding property) as that of the bonding film 15 described above.

That is, the bonding film 35 contains an epoxy-modified silicone material in the same manner as the bonding film 15.

When energy is applied to this bonding film 35, breakage of apart of molecular bonds in the vicinity of a surface (a surface on a side of the vibration plate 40) of the bonding film 35 occurs to activate the surface, whereby the bonding film 35 exhibits a bonding property. Due to this bonding property, the sealing sheet 30 and the vibration plate 40 are bonded to each other.

Incidentally, the bonding film 35 will be described in detail later as well as the bonding film 15 and the bonding film 25.

Further, in this embodiment, a sealing plate is formed of a laminated body having the sealing sheet 30 and the vibration plate 40 laminated on each other. However, this sealing plate may be formed of a single layer or a laminated body having three or more layers laminated on one another.

In the case where the sealing plate is formed of a laminated body having three or more layers laminated on one another, when at least one pair of adjacent layers among the layers in the laminated body are bonded to each other through the bonding film 35, the dimensional accuracy of the laminated body is increased, whereby the dimensional accuracy of the head 1 can be increased.

The piezoelectric element (vibration unit) 50 is bonded (adhered) to a part of an upper surface of the vibration plate 40 (in the vicinity of a center of the upper surface of the vibration plate 40 in FIG. 2) through a bonding film 45*a*.

The piezoelectric element 50 is formed of a laminated body having a piezoelectric layer 51 made of a piezoelectric material and an electrode film 52 for applying a voltage to the piezoelectric layer 51. In such a piezoelectric element 50, when a voltage is applied to the piezoelectric layer 51 through the electrode film 52, strain in response to the applied voltage is generated in the piezoelectric layer 51 (an inverse piezoelectric effect). This strain causes deflection (vibration) of the vibration plate 40 and the sealing sheet 30, thereby changing the volume of each of the ejection liquid storage chambers 21. In this manner, by reliably bonding the piezoelectric element 50 to the vibration plate 40, the strain generated in the piezoelectric element 50 can be reliably converted to deformation of the vibration plate 40 and the sealing sheet 30, and can also be reliably converted to a change in the volume of each of the ejection liquid storage chambers 21.

A direction of laminating the piezoelectric layer 51 and the electrode film 52 is not particularly limited and may be a parallel direction or a perpendicular direction to the vibration plate 40. In the case where the direction of laminating the piezoelectric layer 51 and the electrode film 52 is a perpendicular direction to the vibration plate 40, the piezoelectric element 50 having such an arrangement is particularly referred to as "MLP (Multi Layer Piezo)". If the MLP is used as the piezoelectric element 50, the amount of deformation of the vibration plate 40 can be increased, and therefore, there is an advantage that an adjustment range of the ejection amount of the ink is large.

A surface of the piezoelectric element 50 adjacent to (in contact with) the bonding film 45*a* varies depending on the arrangement method of the piezoelectric element 50, however, it is any of a surface on which the piezoelectric layer is exposed, a surface on which the electrode film is exposed, and a surface on which both of the piezoelectric layer and the electrode film are exposed.

Examples of a constituent material of the piezoelectric layer 51 of the piezoelectric element 50 include barium titanate, lead zirconate, lead titanate zirconate, zinc oxide, aluminum nitride, lithium tantalate, lithium niobate, and quartz.

Examples of a constituent material of the electrode film 52 include various types of metal materials such as Fe, Ni, Co, Zn, Pt, Au, Ag, Cu, Pd, Al, W, Ti, Mo, and alloys each containing any of these metals.

The bonding film 45*a* through which such a piezoelectric element 50 and the vibration plate 40 are bonded to each other may be formed of any material as long as the vibration plate 40 and the piezoelectric element 50 can be bonded or adhered to each other through the bonding film 45*a*, and a constituent material of the bonding film 45*a* is appropriately selected depending on each of the constituent materials of the vibration plate 40 and the piezoelectric element 50. However, examples thereof include adhesives such as an epoxy-based adhesive, a silicone-based adhesive, and a urethane-based adhesive; soldering materials; and brazing materials.

The bonding film 45*a* is not necessarily provided and may be omitted. In this case, bonding (adhering) between the vibration plate 40 and the piezoelectric element 50 can be achieved by fusion (welding) or by a direct bonding method such as solid bonding (such as silicon direct bonding or anodic bonding).

In this embodiment, however, the bonding film 45*a* has the same bonding function (bonding property) as that of the bonding film 15 described above.

That is, the bonding film 45*a* contains an epoxy-modified silicone material in the same manner as the bonding film 15.

When energy is applied to this bonding film 45*a*, breakage of apart of molecular bonds in the vicinity of a surface (a surface on a side of the piezoelectric element 50) of the bonding film 45*a* occurs to activate the surface, whereby the bonding film 45*a* exhibits a bonding property. Due to this bonding property, the vibration plate 40 and the piezoelectric element 50 are bonded to each other.

Incidentally, the bonding film 45*a* will be described in detail later as well as the bonding film 15, the bonding film 25, and the bonding film 35.

The vibration plate 40 described above has a recessed portion 53 formed in an annular shape so as to surround a region where the piezoelectric element 50 is mounted. That is, in the region where the piezoelectric element 50 is mounted, a partial region of the vibration plate 40 is isolated by this annular recessed portion 53 in an island shape.

Incidentally, the bonding film 45*a* is provided in an inside of the annular recessed portion 53.

The electrode film 52 of the piezoelectric element 50 is electrically connected to a driving IC which is not shown. Due to the connection, the operation of the piezoelectric element 50 can be controlled by the driving IC.

Further, the case head 60 is bonded (adhered) to apart of an upper surface of the vibration plate 40 through a bonding film 45*b*. In this manner, by reliably bonding the case head 60 to the vibration plate 40, a so-called cavity portion formed of a laminated body having the nozzle plate 10, the substrate 20, the sealing sheet 30, and the vibration plate 40 is reinforced, and strain, warpage, or the like of the cavity portion can be reliably prevented.

Examples of a constituent material of the case head 60 include silicon materials, metal materials, glass materials, ceramic materials, carbon materials, and resin materials as described above. These materials may be used alone, or a complex material or the like obtained by mixing two or more of these materials may be used.

Among these materials, the constituent material of the case head 60 is preferably a modified polyphenylene ether resin such as polyphenylene sulfide (PPS) or Zylon (registered trademark) or stainless steel. Such a material has sufficient rigidity and therefore is suitable as the constituent material of the case head 60 which supports the head 1.

The bonding film 45*b* through which such a case head 60 and the vibration plate 40 are bonded to each other may be formed of any material as long as the vibration plate 40 and the case head 60 can be bonded or adhered to each other through the bonding film 45*b*. A constituent material of the bonding film 45*b* is appropriately selected depending on each of the constituent materials of the vibration plate 40 and the case head 60, however, examples thereof include adhesives such as an epoxy-based adhesive, a silicone-based adhesive, and a urethane-based adhesive; soldering materials; and brazing materials.

The bonding film 45*b* is not necessarily provided and may be omitted. In this case, bonding (adhering) between the vibration plate 40 and the case head 60 can be achieved by fusion (welding) or by a direct bonding method such as solid bonding (such as silicon direct bonding or anodic bonding).

In this embodiment, however, the bonding film 45*b* has the same bonding function (bonding property) as that of the bonding film 15 described above.

That is, the bonding film 45*b* contains an epoxy-modified silicone material in the same manner as the bonding film 15.

When energy is applied to this bonding film 45*b*, breakage of apart of molecular bonds in the vicinity of a surface (a surface on a side of the case head 60) of the bonding film 45*b* occurs to activate the surface, whereby the bonding film 45*b* exhibits a bonding property. Due to this bonding property, the vibration plate 40 and the case head 60 are bonded to each other.

Incidentally, the bonding film 45*b* will be described in detail later as well as the bonding film 15, the bonding film 25, the bonding film 35, and the bonding film 45*a*.

The bonding film 25, the sealing sheet 30, the bonding film 35, the vibration plate 40, and the bonding film 45*b* have a through-hole 23 at a position corresponding to the ejection liquid supply chamber 22. By the through-hole 23, the ejection liquid supply path 61 provided in the case head 60 and the ejection liquid supply chamber 22 communicate with each other. Together with the ejection liquid supply path 61 and the ejection liquid supply chamber 22, the through-hole 23 constitutes a part of the reservoir 70 serving as the ink chamber which is shared by the plurality of the ejection liquid storage chambers 21 and supplies the ink to the respective chambers 21.

In such ahead 1, after an inner part from the reservoir 70 to the nozzle hole 11 is filled with the ink which has been drawn from an external ejection liquid supply unit (not shown), the piezoelectric element 50 corresponding to each of the ejection liquid storage chambers 21 is operated in response to a recording signal sent from the driving IC. In this manner, deflection (vibration) is generated in the vibration plate 40 and the sealing sheet 30 due to the inverse piezoelectric effect of the piezoelectric element 50. As a result, when the volume of each of the ejection liquid storage chambers 21 is contracted, for example, the pressure in each of the ejection liquid storage chambers 21 instantaneously increases, whereby the ink is pushed out (ejected) from the nozzle hole 11 in the form of liquid droplets.

In this manner, in the head 1, a voltage is applied through the driving IC to the piezoelectric element 50 disposed at a desired printing position, that is, an ejection signal is sequentially input to the piezoelectric element 50 at the desired printing position, whereby it is possible to print an arbitrary letter, figure, or the like.

Incidentally, the head 1 is not limited to those having the structure described above, and may be a head having a structure in which a heater is used as the vibration unit instead of the piezoelectric element 50 (thermal system). Such a head has a structure in which the ink is heated and boiled by the heater so as to increase the pressure in the ejection liquid storage chamber, whereby the ink is ejected from the nozzle hole 11 in the form of liquid droplets.

Further, as other examples of the vibration unit, an electrostatic actuator system and the like can be exemplified.

Incidentally, by forming the vibration unit of the piezoelectric element as described in this embodiment, the degree of deflection generated in the vibration plate 40 and the sealing sheet 30 can be easily controlled. Accordingly, the size of the ink droplet can be easily controlled.

Further, each of the bonding films 35, 45*a*, and 45*b* may not be formed of a material containing an epoxy-modified silicone material as described above, and alternatively, for example, the bonding may be achieved by adhesion using an adhesive such as an epoxy-based adhesive or a urethane-based adhesive or by solid bonding.

Subsequently, a method of forming the bonding film 15 on a base material 20' using a liquid material containing an epoxy-modified silicone material and a method of producing the head 1 including this method will be described.

FIGS. 4A to 7N are vertical cross-sectional views for illustrating a method of producing an ink jet type recording head. In the following description, the upper side of each of FIGS. 4A to 7N is referred to as "upper" and the lower side thereof is referred to as "lower" for convenience of explanation.

A method of producing the head 1 according to this embodiment includes a step of forming the bonding film 25 on the base material 20' and bonding the base material 20' and the sealing sheet 30 to each other through the bonding film 25; a step of forming the bonding film 35 on the sealing sheet 30 and bonding the sealing sheet 30 and the vibration plate 40 to each other through the bonding film 35; a step of forming the through-hole 23 in a part of the bonding film 25, the sealing sheet 30, the bonding film 35 and the vibration plate 40 and also forming the recessed portion 53 in a part of the vibration plate 40; a step of forming the bonding film 45*a* on the vibration plate 40 and bonding the vibration plate 40 and the piezoelectric element 50 to each other through the bonding film 45*a*; a step of forming the bonding film 45*b* on the vibration plate 40 and bonding the vibration plate 40 and the case head 60 to each other through the bonding film 45*b*; a step of processing the base material 20' to form the substrate 20; and a step of forming the bonding film 15 on an opposite side of the substrate 20 from the sealing sheet 30 and bonding the substrate 20 and the nozzle plate 10 to each other through the bonding film 15.

Hereinafter, the respective steps will be sequentially described.

(1) First, as a base material for forming the substrate 20, the base material 20' is prepared. The base material 20' is a material which can be formed into the substrate 20 by processing in a step described later.

Figure 4A:
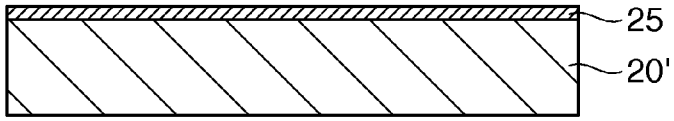
FIGS. 4A to 4F are vertical cross-sectional views for illustrating a method of producing an ink jet type recording head.

Subsequently, as shown in FIG. 4A, the bonding film 25 is formed on the base material 20'. In this embodiment, a method of forming the bonding film 25 is the same as that of forming the bonding film 15 described later.

(2) Subsequently, energy is applied to the bonding film 25. By doing this, the bonding film 25 exhibits a bonding property to the sealing sheet 30. The application of energy to the bonding film 25 can be performed by the same method as that of applying energy to the bonding film 15 described later.

Figure 4B:
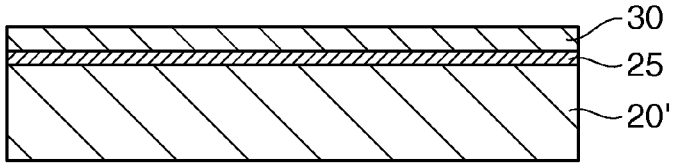

(3) Subsequently, the sealing sheet 30 is prepared. Then, the base material 20' and the sealing sheet 30 are bonded to each other such that the bonding film 25 which exhibits a bonding property and the sealing sheet 30 are in close contact with each other. By doing this, as shown in FIG. 4B, the base material 20' and the sealing sheet 30 are bonded (adhered) to each other through the bonding film 25.

Figure 4C:
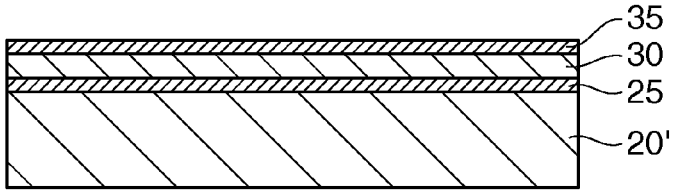

(4) Subsequently, as shown in FIG. 4C, the bonding film 35 is formed on the sealing sheet 30. In this embodiment, a method of forming the bonding film 35 is the same as that of forming the bonding film 15 described later.

(5) Subsequently, energy is applied to the bonding film 35. By doing this, the bonding film 35 exhibits a bonding property to the vibration plate 40. The application of energy to the bonding film 35 can be performed by the same method as that of applying energy to the bonding film 15 described later.

Figure 4D:
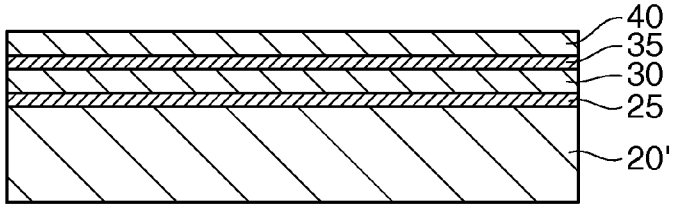

(6) Subsequently, the vibration plate 40 is prepared. Then, the base material 20' provided with the sealing sheet 30 and the vibration plate 40 are bonded to each other such that the bonding film 35 which exhibits a bonding property and the vibration plate 40 are in close contact with each other. By doing this, the sealing sheet 30 and the vibration plate 40 are bonded (adhered) to each other through the bonding film 35. As a result, as shown in FIG. 4D, the base material 20', the sealing sheet 30, and the vibration plate 40 are bonded to one another.

Figure 4E:
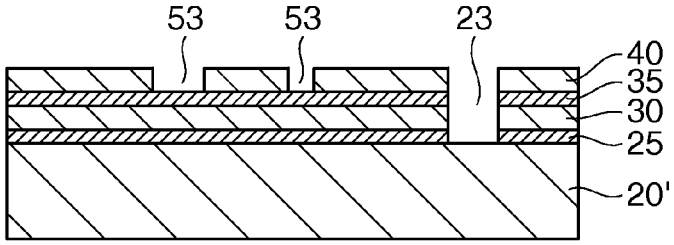

(7) Subsequently, as shown in FIG. 4E, the through-hole 23 is formed at a position corresponding to the ejection liquid supply chamber 22 of the head 1 in a part of the bonding film 25, the sealing sheet 30, the bonding film 35 and the vibration plate 40.

Further, in a part of the vibration plate 40, the recessed portion 53 is formed in an annular shape so as to surround a region where the piezoelectric element 50 is mounted.

The formation of the through-hole 23 and the recessed portion 53 can be performed by one method or a combination of two or more methods selected from physical etching methods such as dry etching, reactive ion etching, beam etching, and photo-assist etching; chemical etching methods such as wet etching; and the like.

Figure 4F:
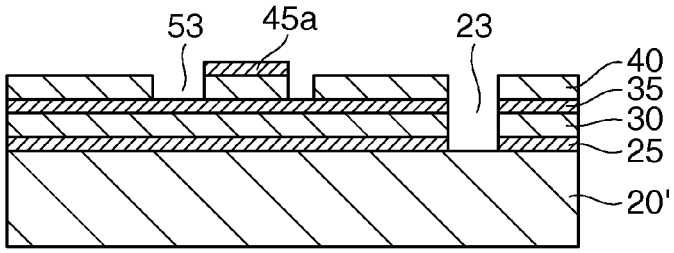

(8) Subsequently, as shown in FIG. 4F, the bonding film 45*a* is formed on the vibration plate 40 in a region where the piezoelectric element 50 is mounted. In this embodiment, a method of forming the bonding film 45*a* is the same as that of forming the bonding film 15 described later.

In the case where the bonding film 45*a* is partially formed in a partial region of the vibration plate 40, the bonding film 45*a* may be formed by, for example, using a mask having a window in the shape corresponding to that of the region where the bonding film 45*a* is to be formed.

(9) Subsequently, energy is applied to the bonding film 45*a*. By doing this, the bonding film 45*a* exhibits a bonding property to the piezoelectric element 50. The application of energy to the bonding film 45*a* can be performed by the same method as that of applying energy to the bonding film 15 described later.

Figure 5G:
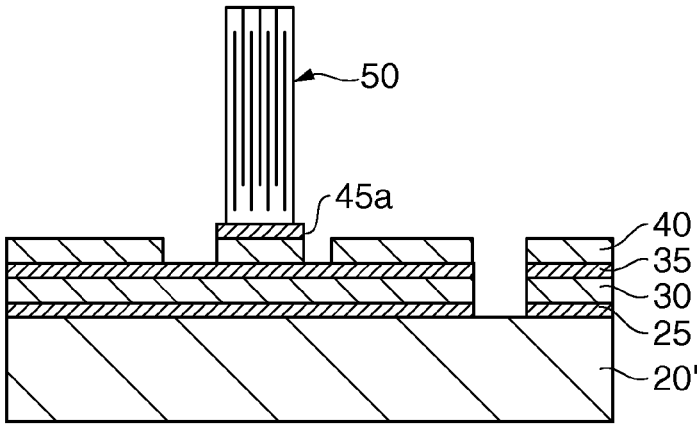
FIGS. 5G to 5I are vertical cross-sectional views for illustrating a method of producing an ink jet type recording head.

(10) Subsequently, the piezoelectric element 50 is prepared. Then, the vibration plate 40 and the piezoelectric element 50 are bonded to each other such that the bonding film 45*a* which exhibits a bonding property and the piezoelectric element 50 are in close contact with each other. By doing this, the vibration plate 40 and the piezoelectric element 50 are bonded (adhered) to each other through the bonding film 45*a*. As a result, as shown in FIG. 5G, the base material 20', the sealing sheet 30, the vibration plate 40, and the piezoelectric element 50 are bonded to one another.

Figure 5H:
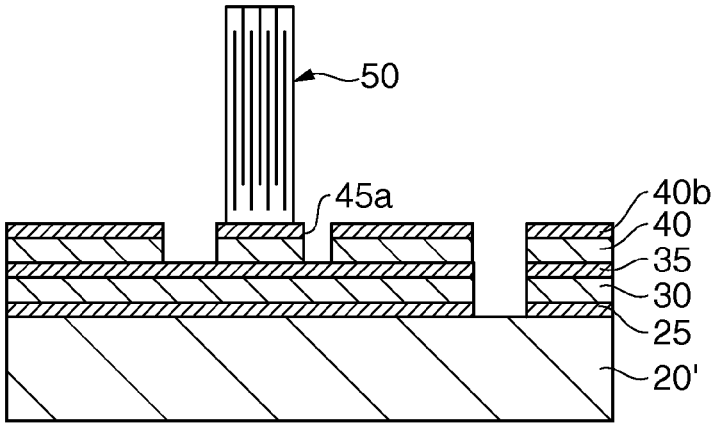

(11) Subsequently, as shown in FIG. 5H, the bonding film 45*b* in a state before energy is applied is formed on the vibration plate 40 in a region where the case head 60 is mounted. In this embodiment, a method of forming the bonding film 45*b* is the same as that of forming the bonding film 15 described later.

In the case where the bonding film 45*b* is partially formed in a partial region of the vibration plate 40, the bonding film 45*b* may be formed by, for example, using a mask having a window in the shape corresponding to that of the region where the bonding film 45*b* is to be formed.

(12) Subsequently, energy is applied to the bonding film 45*b*. By doing this, the bonding film 45*b* exhibits a bonding property to the case head 60. The application of energy to the bonding film 45*b* can be performed by the same method as that of applying energy to the bonding film 15 described later.

Figure 5I:
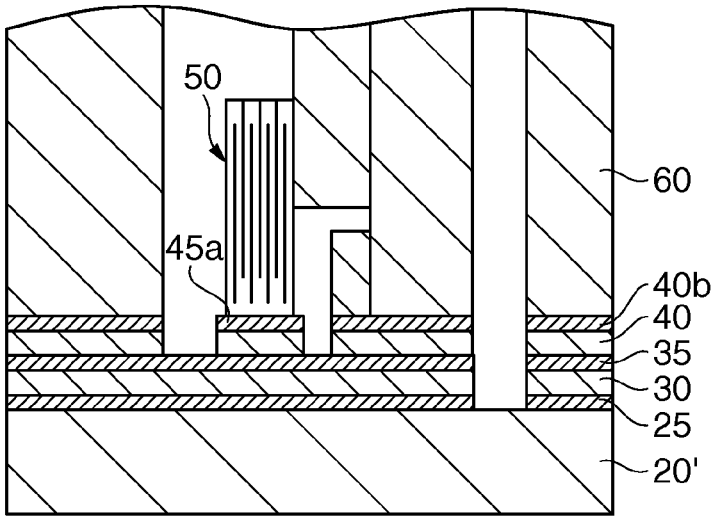

(13) Subsequently, the case head 60 is prepared. Then, the vibration plate 40 and the case head 60 are bonded to each other such that the bonding film 45*b* which exhibits a bonding property and the case head 60 are in close contact with each other. By doing this, the vibration plate 40 and the case head 60 are bonded (adhered) to each other through the bonding film 45*b*. As a result, as shown in FIG. 5I, the base material 20', the sealing sheet 30, the vibration plate 40, the piezoelectric element 50, and the case head 60 are bonded to one another.

(14) Subsequently, the base material 20' having the sealing sheet 30, the vibration plate 40, the piezoelectric element 50, and the case head 60 bonded thereto is turned upside down. Then, a surface on an opposite side of the base material 20' from the sealing sheet 30 is processed to form the respective ejection liquid storage chambers 21 and the ejection liquid supply chamber 22. By doing this, the substrate 20 is obtained from the base material 20' (see FIG. 6J). Further, the ejection liquid supply chamber 22 communicates with the through-hole 23 which is formed in the bonding film 25, the sealing sheet 30, the bonding film 35, and the vibration plate 40, and also communicates with the ejection liquid supply path 61 which is provided in the case head 60, whereby the reservoir 70 is formed.

As a method of processing the base material 20', for example, any of various etching methods as described above can be used.

Here, the case where the respective ejection liquid storage chambers 21 and the ejection liquid supply chamber 22 are formed by processing the base material 20' having the sealing sheet 30, the vibration plate 40, the piezoelectric element 50, and the case head 60 bonded thereto is described, however, the respective ejection liquid storage chambers 21 and the ejection liquid supply chamber 22 may be provided for the base material 20' in advance in the above step (1).

(15) Subsequently, the nozzle plate 10 is bonded to a surface on an opposite side of the substrate 20 from the sealing sheet 30. Hereinafter, a method of bonding the substrate 20 and the nozzle plate 10 to each other will be described in detail.

Incidentally, it is preferred that a surface of the substrate 20 to which the nozzle plate 10 is to be bonded (a surface on which the bonding film 15 is to be formed) is subjected to a surface treatment for increasing an adhesive property to the bonding film 15 in advance. By doing this, the bonding strength between the substrate 20 and the bonding film 15 can be further increased, and in the end, the bonding strength between the substrate 20 and the nozzle plate 10 can be increased.

Examples of the surface treatment include physical surface treatments such as a sputtering treatment and a blast treatment; chemical surface treatments such as a plasma treatment using oxygen plasma, nitrogen plasma, or the like, a corona discharge treatment, an etching treatment, an electron beam irradiation treatment, an ultraviolet irradiation treatment, and an ozone exposure treatment; and a combination of these surface treatments. By performing such a surface treatment, it is possible to clean and activate a region of the substrate 20 in which the bonding film 15 is to be formed.

Among these surface treatments, by performing a plasma treatment, the surface of the substrate 20 can be particularly made optimal for forming the bonding film 15.

In the case where the substrate 20 to be subjected to the surface treatment is formed of a resin material (a polymeric material), a corona discharge treatment, a nitrogen plasma treatment, or the like is particularly preferably performed.

Further, depending on the constituent material of the substrate 20, the bonding strength of the bonding film 15 is sufficiently high even if the surface of the substrate 20 is not subjected to a surface treatment as described above. Examples of the constituent material of the substrate 20 with which such an effect is obtained include materials each mainly containing any of various types of metal-based materials, various types of silicon-based materials, various types of glass-based materials, and the like as described above.

The surface of the substrate 20 formed of such a material is coated with an oxide film. To the surface of such an oxide film, a hydroxy group with a relatively high activity is bonded. Therefore, when the substrate 20 formed of such a material is used, the substrate 20 and the bonding film 15 can be firmly brought into close contact with each other even if a surface treatment as described above is not performed.

In this case, the entire substrate 20 may not be formed of a material as described above, and at least an area in the vicinity of the surface of a region of the substrate 20 in which the bonding film 15 is to be formed may be formed of a material as described above.

Further, in the case where a group or a substance described below is present in the region of the substrate 20 in which the bonding film 15 is to be formed, the bonding strength between the substrate 20 and the bonding film 15 can be made sufficiently high even if a surface treatment as described above is not performed.

As such a group or substance, for example, at least one group or substance selected from the group consisting of functional groups such as a hydroxy group, a thiol group, a carboxyl group, an amino group, a nitro group, and an imidazole group; radicals; open circular molecules; unsaturated bonds such as a double bond and a triple bond; halogens such as F, Cl, Br, and I; and peroxides can be exemplified.

Further, it is preferred to appropriately select and perform a surface treatment from the above various surface treatments so as to obtain the surface having such a group or substance.

Further, instead of performing the surface treatment, an intermediate layer may be formed in advance in at least the region of the substrate 20 in which the bonding film 15 is to be formed.

This intermediate layer may have any function. For example, the intermediate layer preferably has a function of increasing an adhesive property to the bonding film 15, a cushioning property (a buffering function), a function of relaxing stress concentration or the like. By forming the bonding film 15 on the substrate 20 through such an intermediate layer, the bonding strength between the substrate 20 and the bonding film 15 can be increased, whereby a bonded body with high reliability, that is, the head 1 with high reliability can be obtained.

Examples of a constituent material of such an intermediate layer include metal-based materials such as aluminum and titanium; oxide-based materials such as metal oxides and silicon oxides; nitride-based material such as metal nitrides and silicon nitrides; carbon-based materials such as graphite and diamond-like carbon; and self-organized film materials such as silane coupling agents, thiol-based compounds, metal alkoxides, and metal halides. These materials can be used alone or in combination of two or more of them.

Among the intermediate layers formed of any of these various types of materials, when the intermediate layer formed of an oxide-based material is used, the bonding strength between the substrate 20 and the bonding film 15 can be particularly increased.

On the other hand, it is also preferred that a region of the nozzle plate 10 which comes into contact with the bonding film 15 is subjected to a surface treatment for increasing an adhesive property to the bonding film 15 in advance. By doing this, the bonding strength between the nozzle plate 10 and the bonding film 15 can be further increased.

As such a surface treatment, a treatment similar to the above-mentioned surface treatment performed for the substrate 20 can be applied.

Further, it is preferred that an intermediate layer having a function of increasing an adhesive property to the bonding film 15 is formed in advance in a region of the nozzle plate 10 which comes into contact with the bonding film 15 instead of performing the surface treatment. By doing this, the bonding strength between the nozzle plate 10 and the bonding film 15 can be further increased.

As a constituent material of such an intermediate layer, a material similar to the above-mentioned constituent material of the intermediate layer formed on the substrate 20 can be used.

It goes without saying that the above-mentioned surface treatment and formation of the intermediate layer for the substrate 20 and the nozzle plate 10 may be performed for the sealing sheet 30, the vibration plate 40, the piezoelectric element 50, and the case head 60. By doing this, the bonding strength of the respective members can be further increased.

Figure 6J:
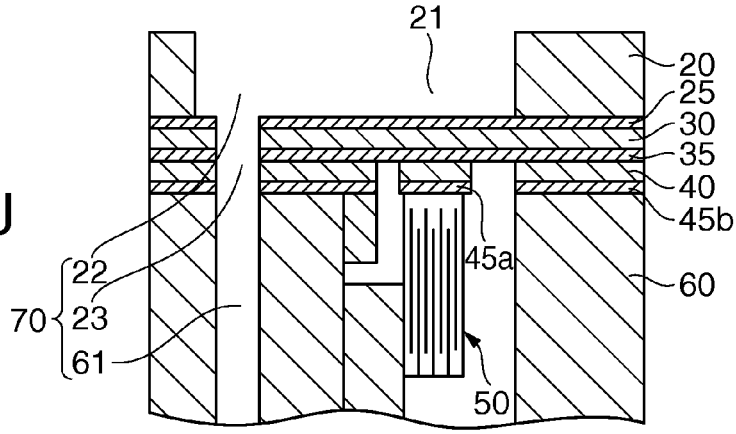
FIGS. 6J to 6L are vertical cross-sectional views for illustrating a method of producing an ink jet type recording head.
Figure 6K:
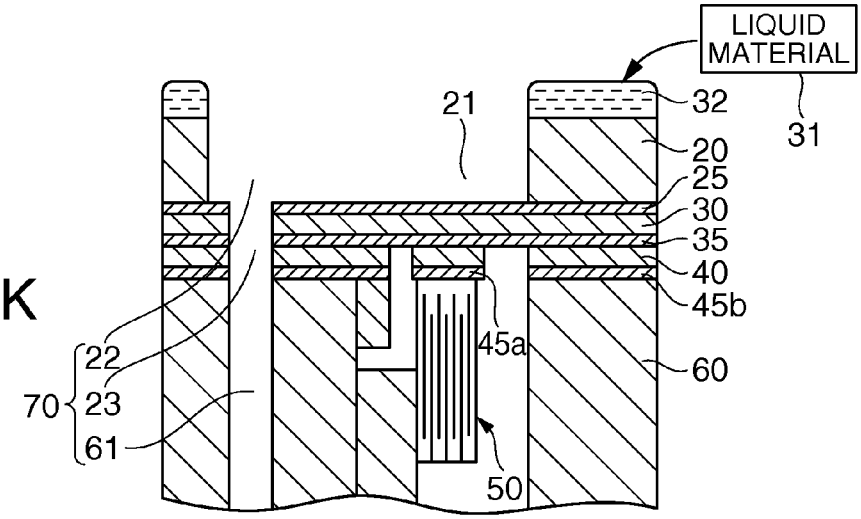

(15-1) Subsequently, a liquid material 31 containing an epoxy-modified silicone material is supplied onto an upper surface of the substrate 20 having the sealing sheet 30, the vibration plate 40, the piezoelectric element 50, and the case head 60 bonded thereto to form a liquid coating film 32 as shown in FIG. 6K.

As a method of supplying the liquid material 31, for example, any of various methods such as a liquid droplet ejecting method (an ink jet method), a spin coating method, and a screen printing method can be used. Among these methods, it is preferred to use a liquid droplet ejecting method.

According to a liquid droplet ejecting method, the liquid material 31 can be reliably supplied selectively onto a target region, for example, a region of the upper surface of the substrate 20 in which the bonding film 15 is to be formed.

The "epoxy-modified silicone material" as used in this specification is a material contained in the liquid material 31 in a state before curing and used as a main material of the bonding film 15 formed by drying and/or curing the liquid material 31 in the subsequent step (15-2), and is a compound obtained by an addition reaction between a silicone material and an epoxy resin.

Incidentally, in the following description, an operation of drying and/or curing the liquid material 31 (liquid coating film 32), in other words, an operation of curing the epoxy-modified silicone material contained in the liquid material 31 (liquid coating film 32), and in the case where a solvent or a dispersion medium is contained in the liquid material 31 (liquid coating film 32), also drying the liquid material 31 (liquid coating film 32) by removing the solvent or the dispersion medium is sometimes referred to as simply "drying and/or curing the liquid material 31 (liquid coating film 32)".

Further, the "silicone material" refers to a compound which has a polyorganosiloxane backbone and in which the main backbone (main chain) is generally composed mainly of an organosiloxane repeating unit and has at least one silanol group. The silicone material may have a branched structure having a branch in the main chain, or may be a cyclic compound in which the main chain is in a cyclic form, or may have a straight-chain structure in which the ends of the main chain are not joined.

For example, in the compound having a polyorganosiloxane backbone, the organosiloxane unit has a structural unit represented by the following general formula (1) at a terminal portion, a structural unit represented by the following general formula (2) at a linking portion, and a structural unit represented by the following general formula (3) at a branched portion.

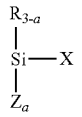
(1)

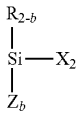
(2)

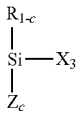
(3)

In the formulae, each R independently represents a substituted or unsubstituted hydrocarbon group, each Z independently represents a hydroxy group or a hydrolyzable group, X represents a siloxane residue, a represents an integer of 1 to 3, b represents 0 or an integer of 1 to 2, and c represents 0 or 1.

The siloxane residue refers to a substituent which is bonded to a silicon atom contained in an adjacent structural unit via an oxygen atom to form a siloxane bond. Specifically, the siloxane residue has a structure of —O—(Si), wherein the Si is a silicon atom contained in the adjacent structural unit.

In such a silicone material, the polyorganosiloxane backbone is preferably branched; in other words, it is preferably composed of a structural unit represented by the above general formula (1), a structural unit represented by the above general formula (2), and a structural unit represented by the above general formula (3). A compound having such a branched polyorganosiloxane backbone (hereinafter, also referred to as "branched compound") is a compound in which the main backbone (main chain) is composed mainly of an organosiloxane repeating unit, and the organosiloxane repeating unit branches out in a middle of the main chain, and the ends of the main chain are not joined.

By using this branched compound, the bonding film 15 is formed such that the branched chains of this compound contained in the liquid material 31 are entangled with each other in the subsequent step (15-2), and therefore, the resulting bonding film 15 has a particularly high film strength.

In the above general formulae (1) to (3), examples of the group R (substituted or unsubstituted hydrocarbon group) include an alkyl group such as a methyl group, an ethyl group, and a propyl group; a cycloalkyl group such as a cyclopentyl group and a cyclohexyl group; an aryl group such as a phenyl group, a tolyl group, and a biphenylyl group; and an aralkyl group such as a benzyl group and a phenylethyl group. Additional examples of the group R include groups in which some or all of the hydrogen atoms attached to the carbon atoms of any of these groups are substituted by, for example, (I) a halogen atom such as a fluorine atom, a chlorine atom, or a bromine atom, (II) an epoxy group such as a glycidoxy group, (III) a (meth) acryloyl group such as a methacryl group, or (IV) an anionic group such as a carboxyl group or a sulfonyl group.

When the group Z is a hydrolyzable group, examples of the hydrolyzable group include an alkoxy group such as a methoxy group, an ethoxy group, a propoxy group, and a butoxy group; a ketoxime group such as a dimethyl ketoxime group and a methyl ethyl ketoxime group; an acyloxy groups such as an acetoxy group; and an alkenyloxy group such as an isopropenyloxy group and an isobutenyloxy group.

Further, as the branched compound, a compound having a molecular weight of about $1\times10^4$ to $1\times10^6$ is preferred, and a compound having a molecular weight of about $1\times10^5$ to $1\times10^6$ is more preferred. By setting the molecular weight in this range, the viscosity of the liquid material 31 can be relatively easily set in a range as described later.

It is preferred that the branched compound has a plurality of silanol groups (hydroxy groups) within the compound. In other words, it is preferred that the compound has a plurality of Z groups in any of the structural units represented by the above general formulae (1) to (3), and that these Z groups are hydroxy groups. With such a structure, the hydroxy group of the silicone material and the hydroxy group of the epoxy resin can be reliably bonded to each other, and therefore, the epoxy-modified silicone material obtained by a dehydration condensation reaction between the silicone material and the epoxy resin can be reliably synthesized. Further, when the bonding film 15 is obtained by drying and/or curing the liquid material 31 (liquid coating film 32) in the subsequent step (15-2), the hydroxy groups contained in the silanol groups remaining in the epoxy-modified silicone material are bonded to each other, and therefore, the resulting bonding film 15 has a higher film strength.

Further, in the case where a substrate in which a hydroxy group is exposed from its bonding face (surface) as described above is used as the substrate 20, a hydroxy group remaining in the epoxy-modified silicone material and the hydroxy group of the substrate 20 are bonded to each other, and therefore, the epoxy-modified silicone material can be bonded to the substrate 20 not only through a physical bond, but also through a chemical bond. As a result, the bonding film 15 is firmly bonded to the bonding face of the substrate 20.

Further, it is preferred that the branched compound has a phenyl group as the hydrocarbon group in the compound. In other words, the compound preferably has a phenyl group as the group R in any of the above general formulae (1) to (3). With such a structure, the reactivity of the silanol group contained in the branched compound (silicone material) is further increased, and therefore, the bonding between the hydroxy groups contained in adjacent silicone materials is more smoothly carried out. Further, with the structure in which a phenyl group is contained in the bonding film 15, the rigidity is improved due to the structural property and as a result, an advantage is also obtained that the resulting bonding film 15 has a higher film strength.

Further, the hydrocarbon group which is not a phenyl group is preferably a methyl group. In other words, the group R which is not a phenyl group in the structural unit represented by any of the above general formulae (1) to (3) is preferably a methyl group. A compound having such a structure is relatively easily obtained and is inexpensive. Also in the later step (15-3), the methyl group is easily cleaved by applying energy for bonding to the bonding film 15, and as a result, it is possible to reliably allow the bonding film 15 to exhibit a bonding property. Accordingly, such a compound is preferably used as the branched compound (silicone material) of the epoxy-modified silicone material.

In light of the above description, as the silicone material, for example, a material (branched compound) which has a structural unit represented by the following chemical formula (4) in a branched portion, a structural unit represented by at least one of the following chemical formulae (5) and (6) in a linking portion, and a structural unit represented by at least one of the following chemical formulae (7) and (8) in a terminal portion is preferably used.

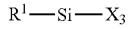
(4)

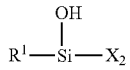
(5)

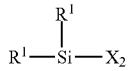
(6)

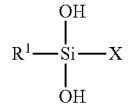
(7)

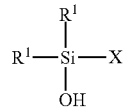
(8)

In the formulae, each $R^1$ independently represents a methyl group or a phenyl group, at least one of which represents a phenyl group, and X represents a siloxane residue.

Further, the above-mentioned branched compound is a material relatively high in flexibility. Therefore, when the head 1 is obtained by bonding the nozzle plate 10 to the substrate 20 through the bonding film 15 in the later step (15-4), even if, for example, the respective constituent materials of the substrate 20 and the nozzle plate 10 are different, stress generated between the substrate 20 and the nozzle plate 10 accompanying thermal expansion can be reliably reduced. Accordingly, in the head 1 obtained in the end, the occurrence of peeling in the interfaces between the substrate 20 and the bonding film 15 and between the nozzle plate 10 and the bonding film 15 can be reliably prevented.

Further, the branched compound has excellent chemical resistance, and therefore can be effectively used in the bonding of a member exposed to a chemical or the like for a long period of time. Specifically, for example, if bonding of a member is achieved using the bonding film 35 when a liquid droplet ejection head of an industrial ink jet printer using an organic-based ink which is highly corrosive to a resin material is produced, the durability of the printer can be reliably increased. Further, the branched compound also has excellent heat resistance, and therefore can be effectively used also in the bonding of a member exposed to a high temperature.

The "epoxy resin" as used in this specification refers to a compound having an epoxy group at an end thereof and may be any of a monomer, an oligomer, or a polymer having an epoxy group. An epoxy resin containing at least two epoxy groups in each molecule is preferably used.

When such an epoxy resin is subjected to an addition reaction with the silicone material, an epoxy group of the epoxy resin and a silanol group (hydroxy group) of the silicone material undergo an addition reaction, whereby an epoxy-modified silicone material in which the epoxy resin is bonded to the silicone material is obtained.

Such an epoxy resin is not particularly limited, however examples thereof include bisphenol epoxy resins, glycidyl ester epoxy resins, alicyclic epoxy resins, urethane-modified epoxy resins, silicon-containing epoxy resins, polyfunctional phenolic epoxy resins, and glycidyl amine epoxy resin. These may be used alone or in combination of two or more of them.

Further, the epoxy resin preferably has a phenylene group in each molecule. When the bonding film 15 is formed using the epoxy-modified silicone material that contains an epoxy resin having such a structure, the resulting bonding film 15 has a particularly high film strength because of the phenylene group contained in the epoxy resin.

The epoxy resin preferably has a straight-chain molecular structure. The silicone material to which the epoxy resin is bonded generally has a polyorganosiloxane backbone which is a main backbone and has a helical structure. Therefore, the epoxy resin bonded to the silicone material is present in a state of being exposed (projecting out) from the silicone material in a helical form. Thus, if the epoxy resin has a straight-chain molecular structure, when the bonding film 15 is obtained by drying and/or curing the liquid material 31 (liquid coating film 32) in the subsequent step (15-2), a chance in which the epoxy resins contained in the adjacent epoxy-modified silicone materials come into contact with each other can be increased. As a result, in the epoxy-modified silicone materials, the epoxy resins are entangled with each other, and the epoxy groups contained in the epoxy resins are chemically bonded by ring-opening polymerization, whereby the film strength of the resulting bonding film 15 can be reliably increased.

Further, in the case where a substrate in which a hydroxy group is exposed from its bonding face (surface) as described above is used as the substrate 20, when an epoxy resin contained in the epoxy-modified silicone material has a straight-chain structure, the reactivity of addition reaction between an epoxy group remaining in the epoxy resin and a hydroxy group of the substrate 20 is increased, and therefore, the epoxy-modified silicone material can be more reliably bonded to the substrate 20 not only through a physical bond, but also through a chemical bond. As a result, the bonding film 15 is more firmly bonded to the bonding face of the substrate 20.

In light of the above description, as the epoxy resin, for example, a bisphenol epoxy resin is preferably used, and specific examples thereof include a bisphenol-A epoxy resin represented by the following general formula (9).

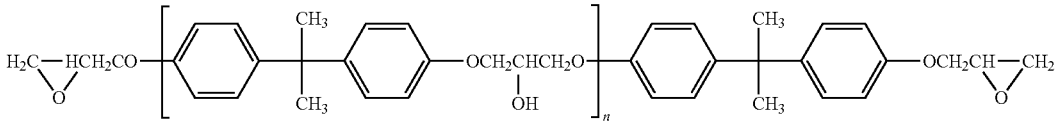

(9)

In the formula, n represents 0 or an integer of 1 or more.

Incidentally, the bisphenol epoxy resin has excellent chemical resistance, and therefore the bonding film 15 having a bisphenol epoxy resin as the epoxy resin is effectively used in the bonding of a member exposed to a chemical or the like for a long period of time. Accordingly, as described herein, the bonding film 15 is preferably used in the bonding of the respective members of a liquid droplet ejection head of an ink jet printer. Further, the bisphenol epoxy resin also has excellent heat resistance.

Incidentally, the liquid material 31 may contain an additive other than the epoxy-modified silicone material. Examples of the additive include various types of amine compounds and various types of acid compounds. When such an additive is contained, this additive is bonded to an epoxy group contained in the epoxy resin. If this additive contains two or more amino groups or carboxyl groups, the epoxy groups can be bonded to each other through the additive. Therefore, the above-mentioned bonding between the epoxy groups is more easily caused, whereby the film strength of the resulting bonding film 15 can be more reliably increased.

Among these compounds, an acid compound containing a carboxyl group is preferred as the additive. In this case, a ketone group will be contained in the bonding film 15 formed by drying and/or curing the liquid material 31 (liquid coating film 32) in the subsequent step (15-2). Therefore, in the case where a substrate in which a hydroxy group is exposed from its bonding face (surface) as described above is used as the substrate 20, a hydrogen bond is formed between a ketone group of the bonding film 15 and a hydroxy group of the substrate 20. Due to this bonding, the bonding film 15 is more firmly bonded to the bonding face of the substrate 20.

The viscosity of such a liquid material 31 at 25° C. is generally preferably from about 0.5 to 200 mPa·s, and more preferably from about 3 to 20 mPa·s. By allowing the viscosity of the liquid material to fall in the above range, the epoxy-modified silicone material can be incorporated in the liquid material 31 in a sufficient amount for forming the bonding film 15 when the liquid material 31 is dried and/or cured in the subsequent step (15-2).

Further, the liquid material 31 contains the epoxy-modified silicone material, however, in the case where the epoxy-modified silicone material itself is in a liquid form and has a viscosity in the above desired range, the epoxy-modified silicone material is used as the liquid material as such. Meanwhile, in the case where the epoxy-modified silicone material itself is in a solid form or is in a liquid form with a high viscosity, a solution or a dispersion liquid containing the epoxy-modified silicone material is used as the liquid material 31.

As a solvent or a dispersion medium for dissolving or dispersing the epoxy-modified silicone material, for example, an inorganic solvent such as ammonia, water, hydrogen peroxide, carbon tetrachloride, or ethylene carbonate; an organic solvent such as a ketone-based solvent (such as methyl ethyl ketone (MEK) or acetone), an alcohol-based solvent (such as methanol, ethanol, or isobutanol), an ether-based solvent (such as diethyl ether or diisopropyl ether), a cellosolve-based solvent (such as methyl cellosolve), an aliphatic hydrocarbon-based solvent (such as hexane or pentane), an aromatic hydrocarbon-based solvent (such as toluene, xylene, or benzene), an aromatic heterocyclic compound-based solvent (such as pyridine, pyrazine, or furan), an amide-based solvent (such as N,N-dimethylformamide (DMF)), a halogen compound-based solvent (such as dichloromethane or chloroform), an ester-based solvent (such as ethyl acetate or methyl acetate), a sulfur compound-based solvent (such as dimethyl sulfoxide (DMSO) or sulfolane), a nitrile-based solvent (such as acetonitrile, propionitrile, or acrylonitrile), or an organic acid-based solvent (such as formic acid or trifluoroacetic acid); a mixed solvent containing any of these solvents; or the like can be used.

Among these, the solvent (dispersion medium) preferably contains toluene or xylene. Such a solvent has high solubility of a silicone material, and therefore, by using such a solvent, a homogeneous liquid material in which the silicone material is homogeneously dissolved can be obtained. Accordingly, the liquid coating film 32 obtained by applying the liquid material 31 becomes homogeneous, and when the liquid coating film 32 is dried and/or cured, the bonding film 15 with little variation in thickness can be obtained.

Further, toluene and xylene have high volatility at normal temperature and pressure, and therefore, such a solvent can be easily evaporated in a short time in a drying process described later. Therefore, even if the bonding film 15 having a large film thickness is formed, it can be efficiently formed.

(15-2) Subsequently, the liquid coating film 32 formed on the substrate 20 is dried and/or cured. That is, in the case where a solvent or a dispersion medium is contained in the liquid coating film 32, the liquid coating film 32 is dried, and at the same time, the epoxy-modified silicone material contained in the liquid coating film 32 is cured. By doing this, the bonding film 15 is formed on an upper surface of the substrate 20.

Further, the bonding film 15 obtained by curing the epoxy-modified silicone material contained in the liquid coating film 32 in this manner is considered to have a film structure as shown in, for example, FIG. 3. The thus obtained cured product of the liquid material 31 becomes the bonding film 15 exhibiting a bonding property by applying energy thereto.

A method of drying and/or curing the liquid coating film 32 is not particularly limited, however, a method of heating the liquid coating film 32 is preferably used. According to such a method, by a simple method of heating the liquid coating film 32, drying and/or curing of the liquid coating film 32 can be easily and reliably carried out.

That is, by a simple method of heating the liquid coating film 32, in the case where a solvent or a dispersion medium is contained in the liquid coating film 32, the liquid coating film 32 can be dried by removing the solvent or the dispersion medium from the liquid coating film 32, and at the same time, the dried liquid coating film 32 can be cured by subjecting the hydroxy groups contained in the epoxy-modified silicone material to a dehydration condensation reaction.

When the bonding film 15 is formed by drying and/or curing the liquid coating film 32 as described above, the hydroxy groups contained in the epoxy-modified silicone material are chemically bonded to each other by a dehydration condensation reaction in the film, and therefore, the bonding film 15 having a high film strength can be formed.

Further, in the interface between the bonding film 15 and the substrate 20, a chemical bond is formed by a dehydration condensation reaction between a hydroxy group contained in the epoxy-modified silicone material and a hydroxy group exposed from a surface of the substrate 20, and also a hydrogen bond is formed between a ketone group contained in the epoxy-modified silicone material and a hydroxy group exposed from a surface of the substrate 20, and therefore, the bonding film 15 having a high adhesive property to the substrate 20 can be formed.

A temperature when the liquid coating film 32 is heated is preferably 25° C. or higher, and more preferably from about 150 to 250° C.

Further, a heating time is preferably from about 0.5 to 48 hours, and more preferably from about 15 to 30 hours.

By drying and/or curing the liquid coating film 32 under the above-mentioned conditions, the bonding film 15 which preferably exhibits a bonding property by applying energy can be reliably formed in the subsequent step (15-3). Further, the hydroxy groups contained in the epoxy-modified silicone material, and moreover, the hydroxy group contained in the epoxy-modified silicone material and the hydroxy group contained in the substrate 20 can be reliably bonded to each other, and therefore, the bonding film 15 having a high film strength can be formed and also firm bonding thereof to the substrate 20 can be achieved.

Further, an ambient pressure when the liquid coating film 32 is dried and/or cured may be an atmospheric pressure, however, a reduced pressure is preferred. As for the degree of reduction in pressure, specifically, a pressure of about $133.3\times10^{-5}$ to 1333 Pa ($1\times10^{-5}$ to 10 Torr) is preferred, and a pressure of about $133.3\times10^{-4}$ to 133.3 Pa ($1\times10^{-4}$ to 1 Torr) is more preferred. By setting the pressure in this range, drying and/or curing of the liquid coating film 32 is accelerated and also the film density of the bonding film 15 is increased, whereby the bonding film 15 having a higher film strength can be formed.

By suitably setting the conditions for forming the bonding film 15 as described above, the film strength and the like of the bonding film 15 to be formed can be made favorable.

An average thickness of the bonding film 15 is preferably from about 10 to 10000 nm, and more preferably from about 50 to 5000 nm. By allowing the average thickness of the bonding film 15 to be formed to fall in the above range by suitably setting the amount of the supplied liquid material, a significant deterioration of the dimensional accuracy of the bonded body formed by bonding the substrate 20 to the nozzle plate 10 can be prevented and the members can be more firmly bonded to each other.

In the case where the average thickness of the bonding film 15 is less than the above-mentioned lower limit, a sufficient bonding strength may not be obtained. On the other hand, in the case where the average thickness of the bonding film 15 exceeds the above-mentioned upper limit, the dimensional accuracy of the bonded body may be significantly deteriorated.

Further, by allowing the average thickness of the bonding film 15 to fall in the above range, the bonding film 15 has elasticity to some extent, and therefore, even if a foreign substance such as a particle adheres to the bonding face of the nozzle plate 10 which is to come into contact with the bonding film 15 when the substrate 20 and the nozzle plate 10 are bonded to each other in the later step, the bonding film 15 and the nozzle plate 10 are bonded to each other such that the bonding film 15 encompasses the particle. Accordingly, a decrease in the bonding strength between the bonding film 15 and the nozzle plate 10 in the interface or the occurrence of peeling in the interface due to the presence of such a particle can be adequately suppressed or prevented.

Further, an embodiment of the invention has a configuration in which the bonding film 15 is formed by supplying the liquid material, and therefore, even if irregularities are present on the bonding face of the substrate 20, the bonding film 15 can be formed such that the bonding film 15 follows the irregular shape of the bonding face of the substrate 20 though it depends on the heights of the irregularities. As a result, the bonding film 15 absorbs the irregularities of the substrate 20 and the surface of the bonding film 15 becomes substantially flat.

Figure 6L:
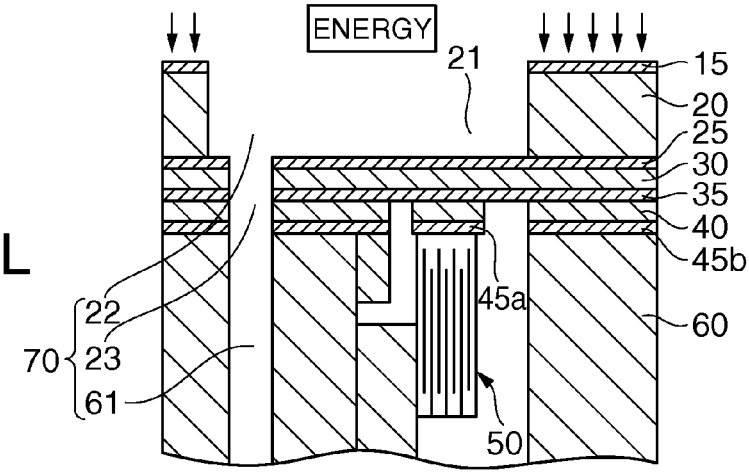

(15-3) Subsequently, energy is applied to the bonding film 15 (see FIG. 6L).

When energy is applied to the bonding film 15, breakage of a part of molecular bonds (such as a Si—$CH_3$ bond or a Si-Phe bond) in the vicinity of a surface of the bonding film 15 occurs to activate the surface, whereby a bonding property to the nozzle plate 10 is exhibited in the vicinity of a surface of the bonding film 15.

The bonding film 15 in such a state can be firmly bonded to the nozzle plate 10 through a chemical bond.

As used herein, a state in which the surface is "activated" refers to a state in which breakage of a part of molecular bonds, specifically, for example, cleavage of a methyl group or a phenyl group contained in the silicone material or the polyester resin occurs the surface of the bonding film 15 as described above, and a bonding hand which is not terminated (hereinafter also referred to as "unpaired bonding hand" or "dangling bond") is formed in the bonding film 15, and also refers to a state in which such an unpaired bonding hand is terminated by a hydroxy group (OH group). Further, a state in which the above-mentioned both states are mixed is also referred to as the state in which the bonding film 15 is "activated".

The application of energy to the bonding film 15 may be performed by any method, and examples of the method include a method in which the bonding film 15 is irradiated with an energy ray, a method in which the bonding film 15 is brought into contact with plasma (that is, plasma energy is applied to the bonding film 15), a method in which the bonding film 15 is heated, a method in which a compressive force (physical energy) is applied to the bonding film 15, and a method in which the bonding film 15 is exposed to ozone gas (that is, chemical energy is applied to the bonding film 15). By doing this, the surface of the bonding film can be efficiently activated. Further, the molecular structure in the bonding film 15 is not broken more than necessary, and therefore, deterioration of the properties of the bonding film 15 can be avoided.

Among the above methods, in this embodiment, it is particularly preferred to use I: a method in which the bonding film 15 is irradiated with an energy ray; and II: a method in which the bonding film 15 is brought into contact with plasma as the method of applying energy to the bonding film 15. With the use of these methods, energy can be relatively easily and efficiently applied to the bonding film 15, and therefore, these methods are preferably used as the method of applying energy.

I: Method in which Bonding Film is Irradiated with Energy Ray

Examples of the energy ray include rays such as an ultraviolet ray and a laser ray; electromagnetic waves such as an X-ray and a γ-ray; particle beams such as an electron beam and an ion beam; and a combination of two or more types of these energy rays.

Among these energy rays, it is particularly preferred to use an ultraviolet ray having a wavelength of about 126 to 300 nm. With the use of an ultraviolet ray having a wavelength in the above range, an amount of the energy to be applied can be made optimal, and therefore, the molecular bonds in the vicinity of the surface of the bonding film 15 can be selectively broken while preventing excessive breakage of the molecular bonds constituting the backbone in the bonding film 15. Accordingly, it is possible to reliably allow the bonding film to exhibit an adhesive property while preventing the deterioration of other properties (such as mechanical properties and chemical properties) of the bonding film 15.

Further, with the use of an ultraviolet ray, it is possible to perform the treatment of a wide area uniformly in a short time. Therefore, the breakage of the molecular bonds can be efficiently performed. Moreover, such an ultraviolet ray has an advantage, for example, that it can be generated by a simple device such as a UV lamp.

Incidentally, the wavelength of the ultraviolet ray is more preferably from about 126 to 200 nm.

Further, in the case where a UV lamp is used, an output power of the UV lamp is preferably from about 1 $mW/cm^2$ to 1 $W/cm^2$, and more preferably from about 5 to 50 $mW/cm^2$, although it varies depending on an area of the bonding film 15. In this case, a distance between the UV lamp and the bonding film 15 is preferably set to about 3 to 3000 mm, and more preferably set to about 10 to 1000 mm.

Further, a time for irradiation with the ultraviolet ray is preferably set to a time sufficient for breaking the molecular bonds in the vicinity of the surface of the bonding film 15. That is, the time is preferably set to a time sufficient for selectively breaking the molecular bonds present in the vicinity of the surface of the bonding film 15. Specifically, the time is preferably from about 1 second to 30 minutes, and more preferably from about 1 second to 10 minutes, although it slightly varies depending on the amount of the ultraviolet ray, the constituent material of the bonding film 15, and the like.

Further, the ultraviolet ray may be temporally irradiated continuously or intermittently (in a pulse-like manner).

On the other hand, examples of the laser ray include pulse oscillation lasers (pulse lasers) such as an excimer laser; and continuous oscillation lasers such as a carbon dioxide laser and a semiconductor laser. Among these lasers, a pulse laser is preferably used. With the use of the pulse laser, heat is hardly accumulated over time in a region of the bonding film 15 which was irradiated with the laser ray. Therefore, alteration or deterioration of the bonding film 15 due to the accumulated heat can be reliably prevented. That is, with the use of the pulse laser, it is possible to prevent the inside of the bonding film 15 from being affected by the accumulated heat.

Further, in the case where the effect of the heat is taken into consideration, it is preferred that a pulse width of the pulse laser is as small as possible. Specifically, the pulse width is preferably 1 ps (picosecond) or less, and more preferably 500 fs (femtoseconds) or less. By setting the pulse width in the above range, it is possible to adequately suppress the effect of the heat generated in the bonding film 15 due to the irradiation with the laser ray. Incidentally, a pulse laser having a small pulse width which falls in the above range is called a "femtosecond laser".

Further, a wavelength of the laser ray is not particularly limited, however, it is preferably, for example, from about 200 to 1200 nm, and more preferably from about 400 to 1000 nm.

Further, in the case of the pulse laser, a peak output power of the laser ray is preferably from about 0.1 to 10 W, and more preferably from about 1 to 5 W, although it varies depending on the pulse width.

Further, a repetitive frequency of the pulse laser is preferably from about 0.1 to 100 kHz, and more preferably from about 1 to 10 kHz. By setting the frequency of the pulse laser in the above range, the molecular bonds in the vicinity of the surface can be selectively broken.

Incidentally, it is preferred that various conditions for the laser ray as described above are appropriately adjusted such that a temperature of a region of the bonding film 15 which was irradiated with the laser ray falls in the range of normal temperature (room temperature) to about 600° C., more preferably from about 200 to 600° C., and further more preferably from about 300 to 400° C. By doing this, the temperature of the region of the bonding film 15 which was irradiated with the laser ray is prevented from significantly rising and the molecular bonds in the vicinity of the surface of the bonding film 15 can be selectively broken.

Further, it is preferred that the laser ray is irradiated to the bonding film 15 while adjusting a focus of the laser ray on the surface of the bonding film 15 such that the laser ray scans along the surface of the bonding film 15. By doing this, the heat generated by the irradiation with the laser ray is accumulated locally in the vicinity of the surface of the bonding film 15. As a result, the molecular bonds present in the surface of the bonding film 15 can be selectively broken.

Further, the irradiation of the bonding film 15 with the energy ray may be performed in any atmosphere, and specific examples of the atmosphere include an air atmosphere; an oxidizing gas atmosphere such as an oxygen atmosphere; a reducing gas atmosphere such as a hydrogen atmosphere; an inert gas atmosphere such as a nitrogen or argon atmosphere; and a reduced pressure (vacuum) atmosphere obtained by reducing the pressure from any of these atmospheres. Among these atmospheres, the irradiation is preferably performed in an air atmosphere (particularly, an atmosphere having a low dew point). By doing this, ozone gas is generated in the vicinity of the surface of the bonding film 15 and the surface of the bonding film 15 can be more smoothly activated. Further, by doing this, the labor time and cost for controlling the atmosphere can be saved, and the irradiation with the energy ray can be more easily performed.

As described above, according to the method of irradiation with an energy ray, the application of energy can be easily performed selectively to the bonding film 15, and therefore, for example, alteration or deterioration of the substrate 20 due to the application of the energy can be prevented.

Further, according to the method of irradiation with an energy ray, a magnitude of the energy to be applied can be accurately and easily adjusted. Therefore, it is possible to adjust the number of molecular bonds to be broken in the bonding film 15. By adjusting the number of molecular bonds to be broken in this manner, it is possible to easily control the bonding strength between the substrate 20 and the nozzle plate 10.

That is, by increasing the number of molecular bonds to be broken in the vicinity of the surface of the bonding film 15, the number of active hands formed in the vicinity of the surface thereof is increased, and therefore, it is possible to further increase the bonding property exhibited by the bonding film 15. On the other hand, by decreasing the number of molecular bonds to be broken in the vicinity of the surface of the bonding film 15, the number of active hands formed in the vicinity of the surface thereof is decreased, and therefore, it is possible to suppress the bonding property exhibited by the bonding film 15.

Incidentally, in order to adjust the magnitude of the energy to be applied, for example, conditions such as a type of the energy ray, an output power of the energy ray, and an irradiation time of the energy ray may be adjusted.

Further, according to the method of irradiation with an energy ray, large energy can be applied in a short time, and therefore, energy can be more efficiently applied.

II: Method in which Bonding Film is Brought into Contact with Plasma

The bonding film 15 may be brought into contact with plasma under a reduced pressure, however, it is preferably performed under an atmospheric pressure. That is, the bonding film 15 is preferably treated with atmospheric pressure plasma. With the use of the treatment with atmospheric pressure plasma, the environment of the bonding film 15 is not in a reduced pressure state, and therefore, when a methyl group contained in, for example, a polydimethylsiloxane backbone of the epoxy-modified silicone material is cleaved and removed (when the bonding film 15 is activated) due to the action of plasma, excessive cleavage of the methyl group can be prevented from proceeding.

Figure 8:
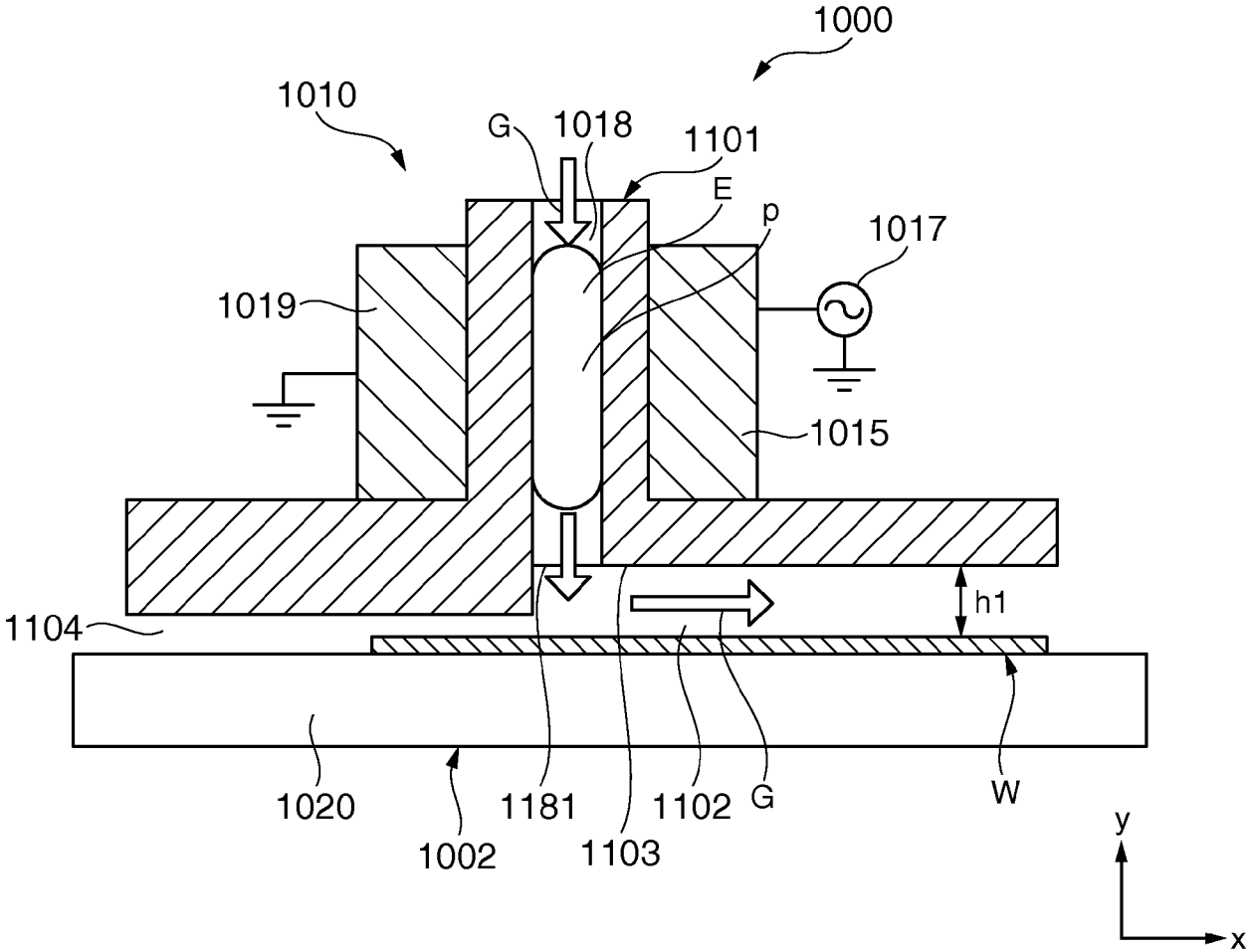
FIG. 8 is a schematic view showing a structure of an atmospheric pressure plasma device.

Such a plasma treatment under an atmospheric pressure can be performed using an atmospheric pressure plasma device shown in FIG. 8.

FIG. 8 is a schematic view showing a structure of an atmospheric pressure plasma device.

An atmospheric pressure plasma device 1000 shown in FIG. 8 is provided with a conveying device 1002 which conveys the substrate 20 having the bonding film 15 formed thereon (hereinafter simply referred to as "substrate W to be treated") and a head 1010 placed above the conveying device 1002.

In this atmospheric pressure plasma device 1000, a plasma generation region p in which plasma is generated is formed between an application electrode 1015 and a counter electrode 1019 in the head 1010.

Hereinafter, the structures of the respective members will be described.

The conveying device 1002 has a movable stage 1020 on which the substrate W to be treated can be mounted. This movable stage 1020 can move in the x-axis direction in response to the operation of a moving unit (not shown) in the conveying device 1002.

Incidentally, the movable stage 1020 is formed of, for example, a metal material such as stainless steel or aluminum.

The head 1010 has a head main body 1101, the application electrode 1015, and the counter electrode 1019.

In the head 1010, a gas supply path 1018 for supplying process gas G converted to plasma is provided in a gap 1102 between an upper surface of the movable stage 1020 (conveying device 1002) and a lower surface 1103 of the head 1010.

The gas supply path 1018 opens at an opening 1181 formed in the lower surface 1103 of the head 1010. Further, as shown in FIG. 8, a difference in level is formed on the left side of the lower surface 1103. Due to this, a gap 1104 between a portion on the left side of the head main body 1101 and the movable stage 1020 is smaller (narrower) than the gap 1102. Accordingly, the process gas G converted to plasma is suppressed or prevented from entering into the gap 1104 and preferentially flows in the positive x-axis direction.

Incidentally, the head main body 1101 is formed of, for example, a dielectric material such as alumina or quartz.

In the head main body 1101, the application electrode 1015 and the counter electrode 1019 are disposed facing each other such that they sandwich the gas supply path 1018 so as to constitute a pair of parallel plate electrodes. The application electrode 1015 is electrically connected to a high-frequency power source 1017 and the counter electrode 1019 is grounded.

The application electrode 1015 and the counter electrode 1019 are formed of, for example, a metal material such as stainless steel or aluminum.

In the case where the substrate W to be treated is subjected to a plasma treatment using such an atmospheric pressure plasma device 1000, first, a voltage is applied between the application electrode 1015 and the counter electrode 1019 to generate an electric field E. In such a state, the process gas G is allowed to flow into the gas supply path 1018. At this time, the process gas G flowing into the gas supply path 1018 is converted to plasma by releasing electrons due to the action of the electric field E. The resulting process gas G converted to plasma is supplied into the gap 1102 from the opening 1181 on a side of the lower surface 1103. By doing this, the process gas G converted to plasma comes into contact with the surface of the bonding film 15 provided on the substrate W to be treated, whereby the plasma treatment is carried out.

By using such an atmospheric pressure plasma device 1000, the bonding film 15 can be easily and reliably brought into contact with plasma and the bonding film 15 can be activated.

Here, a distance between the application electrode 1015 and the movable stage 1020 (substrate W to be treated), that is, a height of the gap 1102 (a length represented by h1 in FIG. 8) is appropriately determined by taking into consideration the output power of the high-frequency power source 1017, the type of plasma treatment performed for the substrate W to be treated, or the like, however, it is preferably from about 0.5 to 10 mm, and more preferably from about 0.5 to 2 mm. By setting the distance in the above range, the bonding film 15 can be more reliably activated by bringing the bonding film 15 into contact with plasma.

Further, the voltage to be applied between the application electrode 1015 and the counter electrode 1019 is preferably from about 1.0 to 3.0 kVp-p, and more preferably from about 1.0 to 1.5 kVp-p. By setting the voltage in the above range, the electric field E can be more reliably generated between the application electrode 1015 and the movable stage 1020, and the process gas G supplied to the gas supply path 1018 can be reliably converted to plasma.

A frequency (frequency of the voltage to be applied) of the high-frequency power source 1017 is not particularly limited, however, it is preferably from about 10 to 50 MHz, and more preferably from about 10 to 40 MHz.

The type of process gas G is not particularly limited, and examples thereof include rare gases such as helium gas and argon gas; and oxygen gas. These gases can be used alone or in combination of two or more of them. Above all, as the process gas G, a gas containing a rare gas as a main component is preferably used, and particularly, a gas containing helium gas as a main component is preferably used.

That is, the plasma to be used for the treatment is preferably plasma converted from a gas containing helium gas as a main component. When the gas (process gas G) containing helium gas as a main component is used and converted into plasma, little ozone is generated, and therefore, alteration (oxidation) of the surface of the bonding film 15 due to ozone can be prevented. As a result, a decrease in the degree of activation of the bonding film 15 can be suppressed, in other words, the bonding film 15 can be reliably activated. Moreover, the activation of the bonding film 15 can be performed reliably in a short time.

In this case, a supply rate of the gas containing helium gas as a main component to the gas supply path 1018 is preferably from about 1 to 20 SLM, and more preferably from about 5 to 15 SLM. By setting the supply rate in the above range, the degree of activation of the bonding film 15 can be easily controlled.

Further, the content of helium gas in the gas (process gas G) is preferably 85 vol % or more, and more preferably 90 vol % or more (including also 100%). By setting the content in the above range, the effect described above can be more remarkably exhibited.

Further, the moving speed of the movable stage 1020 is not particularly limited, however, it is preferably from about 1 to 20 mm/sec, and more preferably from about 3 to 6 mm/sec. By bringing the bonding film 15 into contact with plasma at such a speed, the bonding film 15 can be sufficiently and reliably activated even in a short time.

Even if such a method of bringing the bonding film into contact with plasma is used, the same effect as described above for the method of irradiation with an energy ray is obtained.

Figure 7M:
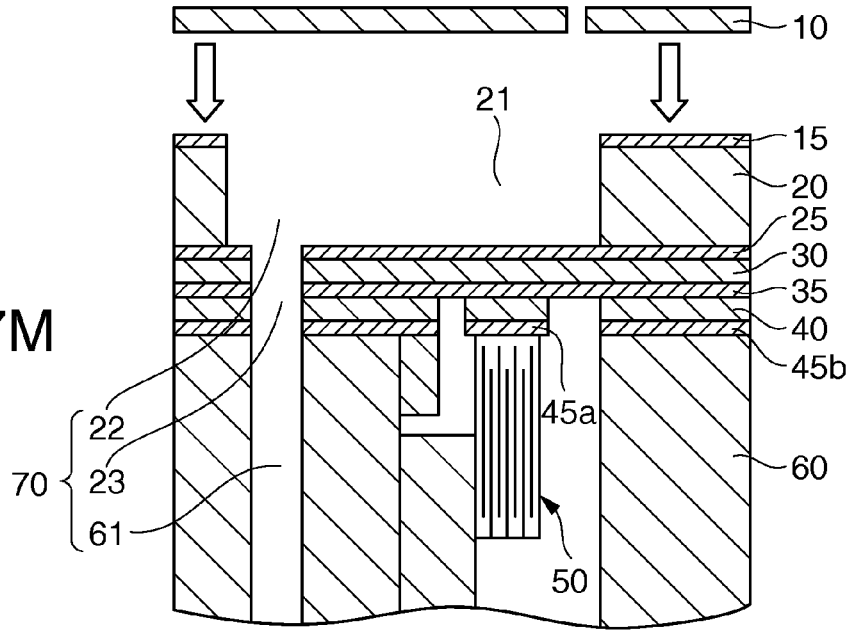
FIGS. 7M and 7N are vertical cross-sectional views for illustrating a method of producing an ink jet type recording head.
Figure 7N:
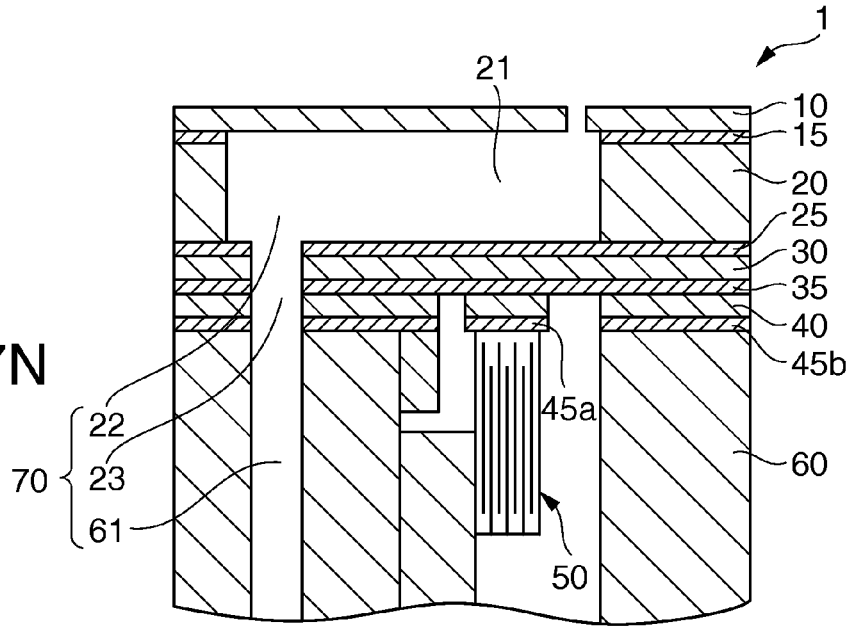

(15-4) Subsequently, the nozzle plate 10 is prepared. Then, as shown in FIG. 7M, the substrate 20 and the nozzle plate 10 are bonded to each other such that the bonding film 15 and the nozzle plate 10 are in close contact with each other. By doing this, since the surface of the bonding film 15 exhibits a bonding property to the nozzle plate 10 in the above step (15-3), the bonding film 15 and the nozzle plate 10 are chemically bonded to each other. As a result, the substrate 20 and the nozzle plate 10 are bonded to each other through the bonding film 15, whereby the head 1 as shown in FIG. 7N is obtained.

Here, it is preferred that the coefficients of thermal expansion of the substrate 20 and the nozzle plate 10 which are bonded to each other as described above are substantially equal to each other. If the coefficients of thermal expansion of the substrate 20 and the nozzle plate 10 are substantially equal to each other, when these members are bonded to each other, stress accompanying thermal expansion is unlikely to be caused in the bond interface. As a result, in the head 1 obtained in the end, the occurrence of problems such as peeling can be reliably prevented.

Further, even in the case where the coefficients of thermal expansion of the substrate 20 and the nozzle plate 10 are different from each other, the substrate 20 and the nozzle plate 10 can be firmly bonded to each other in high dimensional accuracy by making the conditions for bonding the substrate 20 and the nozzle plate 10 to each other optimal as follows.

That is, in the case where the coefficients of thermal expansion of the substrate 20 and the nozzle plate 10 are different from each other, it is preferred that the bonding is performed at a temperature as low as possible. By performing the bonding at a low temperature, thermal stress generated in the bond interface can be further reduced.

Specifically, it is preferred that the substrate 20 and the nozzle plate 10 are bonded to each other in a state where the temperature of each of the substrate 20 and the nozzle plate 10 is from about 25 to 50° C., and more preferably from about 25 to 40° C., although the conditions depend on a difference in the coefficient of thermal expansion between the substrate 20 and the nozzle plate 10. When the temperature is in the above range, even if the difference in the coefficient of thermal expansion between the substrate 20 and the nozzle plate 10 is large to some extent, thermal stress generated in the bond interface can be sufficiently reduced. As a result, the occurrence of warpage, peeling, or the like in the head 1 can be reliably prevented.

Further, in the case where the difference in the coefficient of thermal expansion between the substrate 20 and the nozzle plate 10 is $5\times10^{-5}$/K or more, it is strongly recommended that the bonding be performed at a temperature as low as possible as described above. Incidentally, by using the bonding film 15, the substrate 20 and the nozzle plate 10 can be firmly bonded to each other even at a low temperature as described above.

Further, it is preferred that the substrate 20 and the nozzle plate 10 have a different rigidity. If so, the substrate 20 and the nozzle plate 10 can be more firmly bonded to each other.

Incidentally, in this embodiment, as described in the above step (15-3) and this step (15-4), after energy is applied to the bonding film 15 to allow the bonding film 15 to exhibit a bonding property in the vicinity of the bonding face (surface) thereof, the substrate 20 and the nozzle plate 10 are brought into contact with each other through the bonding film 15, whereby the head 1 is obtained. However, it is not limited thereto, and the head 1 may be obtained as follows. After the substrate 20 and the nozzle plate 10 are brought into contact with each other through the bonding film 15, energy is applied to the bonding film 15, thereby obtaining the head 1. That is, the head 1 may be obtained by reversing the order of the above step (15-3) and this step (15-4). Also in the case where the head 1 is obtained by performing the respective steps in such an order, the same effect as described above is obtained.

Here, a mechanism in which the substrate 20 having the bonding film 15 formed thereon and the nozzle plate 10 are bonded to each other in this step will be described.

For example, the case where a hydroxy group is exposed in a region of the nozzle plate 10 to be bonded to the substrate 20 will be described as an example. When the substrate 20 and the nozzle plate 10 are bonded to each other such that the bonding film 15 and the nozzle plate 10 come into contact with each other in this step, a hydroxy group present on the surface of the bonding film 15 and the hydroxy group present in the region of the nozzle plate 10 are attracted to each other through a hydrogen bond and an attractive force is generated between the hydroxy groups. It is considered that due to this attractive force, the substrate 20 having the bonding film 15 formed thereon and the nozzle plate 10 are bonded to each other.

Further, the hydroxy groups attracted to each other through the hydrogen bond are detached from the surface by dehydration condensation depending on conditions such as a temperature. As a result, in the contact interface between the bonding film 15 and the nozzle plate 10, the bonding hands to which the hydroxy groups have been bonded are bonded to each other. It is considered that due to this bond, the substrate 20 and the nozzle plate 10 are more firmly bonded to each other through the bonding film 15.

Further, in the case where bonding hands which are not terminated, in other words, unpaired bonding hands (dangling bonds) are present on the surface or in the inside of the bonding film 15 formed on the substrate 20 and on the lower surface or in the inside of the nozzle plate 10, when the substrate 20 and the nozzle plate 10 are bonded to each other, these unpaired bonding hands are rebonded to each other. This rebonding is caused in a complicated manner such that the bonds are overlapped (entangled) with one another, and therefore, network-like bonds are formed in the bond interface. Due to this, the bonding film 15 and the nozzle plate 10 are particularly firmly bonded to each other.

Incidentally, the active state of the surface of the bonding film 15 activated in the above step (15-3) is lowered over time. Therefore, it is preferred that after completion of the above step (15-3), this step (15-4) is performed as soon as possible. Specifically, this step (15-4) is performed preferably within 60 minutes, and more preferably within 5 minutes after completion of the above step (15-3). If this step is performed within such a time period, the surface of the bonding film 15 maintains a sufficiently active state, and therefore, when the substrate 20 having the bonding film 15 formed thereon and the nozzle plate 10 are bonded to each other in this step, a sufficient bonding strength between these members can be obtained.

In other words, the bonding film 15 before being activated is a bonding film obtained by drying and/or curing the epoxy-modified silicone material, and therefore, it is relatively chemically stable and has excellent weather resistance. For this reason, the bonding film 15 before being activated is suitable for long-term storage. Therefore, it is effective to perform as follows from the viewpoint of production efficiency of the head 1. A large number of such substrates 20 having the bonding film 15 formed thereon are produced or purchased and stored in advance, and immediately before the bonding in this step is performed, only a necessary number of the substrates 20 are subjected to the application of energy described in the above step (15-3).

The bonding strength between the substrate 20 and the nozzle plate 10 bonded to each other as described above is preferably 5 MPa (50 kgf/cm$^2$) or more, and more preferably 10 MPa (100 kgf/cm$^2$) or more. If such a bonding strength is obtained, the occurrence of peeling in the bond interface can be sufficiently prevented, and the head 1 having high reliability is obtained.

The head 1 is produced by undergoing the steps as described above.

Incidentally, when or after the head 1 is obtained, this head 1 may be subjected to at least one step (a step of increasing the bonding strength of the head 1) of the following two steps ((16A) and (16B)) as needed. By doing this, the bonding strength of the head 1 can be further increased easily.

(16A) Pressure is applied to the obtained head 1 in a direction such that the nozzle plate 10 and the substrate 20 come close to each other.

By doing this, the surfaces of the bonding film 15 come closer to the surface of the nozzle plate 10 and the surface of the substrate 20, whereby the bonding strength in the head 1 can be further increased.

Further, by applying pressure to the head 1, spaces remaining in the bond interface in the head 1 are compressed and eliminated, whereby the bonding area can be further increased. In this manner, the bonding strength in the head 1 can be further increased.

Incidentally, this pressure may be appropriately adjusted according to the respective constituent materials or the respective thicknesses of the substrate 20 and the nozzle plate 10, the conditions of the bonding apparatus and the like. Specifically, the pressure is preferably from about 0.2 to 10 MPa, and more preferably from about 1 to 5 MPa, although it slightly varies depending on the respective constituent materials or the respective thicknesses of the substrate 20 and the nozzle plate 10. By setting the pressure in the above range, the bonding strength of the head 1 can be reliably increased. Incidentally, this pressure may exceed the above upper limit, however, a damage or the like may be caused to the substrate 20 or the nozzle plate 10 depending on the respective constituent materials of the substrate 20 and the nozzle plate 10.

Further, a pressure application time is not particularly limited, however, it is preferably from about 10 seconds to 30 minutes. The pressure application time may be suitably changed depending on the magnitude of the applied pressure. Specifically, in the case where the magnitude of the pressure applied to the head 1 is high, even if the pressure application time is short, the bonding strength can be increased.

(16B) The obtained head 1 is heated.

By doing this, the bonding strength in the head 1 can be further increased.

At this time, the temperature when the head 1 is heated is not particularly limited as long as it is higher than room temperature and lower than the heat-resistant temperature of the head 1, however, it is preferably from about 25 to 100° C., and more preferably from about 50 to 100° C. If the head 1 is heated at a temperature in the above range, the bonding strength thereof can be reliably increased while reliably preventing alteration or deterioration of the head 1 by heat.

Further, a heating time is not particularly limited, however, it is preferably from about 1 to 30 minutes.

Further, in the case where both of the steps (16A) and (16B) are performed, it is preferred that these steps are performed simultaneously. That is, it is preferred that the head 1 is heated while applying pressure thereto. By doing this, an effect of application of pressure and an effect of heating are synergistically enhanced, whereby the bonding strength of the head 1 can be particularly increased.

By performing a step as described above, the bonding strength in the head 1 can be further increased easily.

Incidentally, in the above description, the case where the substrate 20 and the nozzle plate 10 are bonded to each other such that the bonding film 15 formed on the substrate 20 and the nozzle plate 10 are in close contact with each other is described, however, the substrate 20 and the nozzle plate 10 may be bonded to each other such that the bonding film 15 formed on the lower surface of the nozzle plate 10 and the substrate 20 are in close contact with each other.

Figure 9:
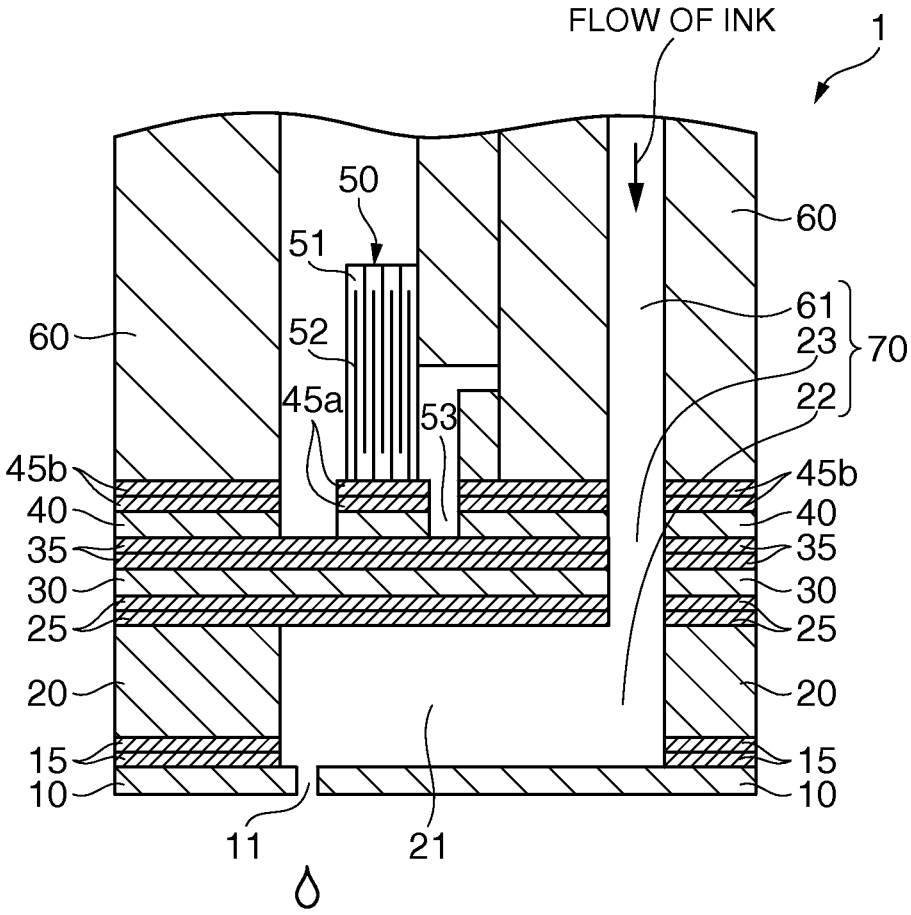
FIG. 9 is a cross-sectional view showing another structural example of the ink jet type recording head according to the first embodiment.

In addition, the bonding film 15 may be formed on both of the substrate 20 and the nozzle plate 10 as shown in FIG. 9.

FIG. 9 is a cross-sectional view showing another structural example of the ink jet type recording head according to this embodiment. In the following description, the upper side of FIG. 9 is referred to as "upper" and the lower side thereof is referred to as "lower" for convenience of explanation.

In the head 1 shown in FIG. 9, the substrate 20 and the nozzle plate 10 are bonded (adhered) to each other such that the bonding film 15 formed on the lower surface of the substrate 20 and the bonding film 15 formed on the upper surface of the nozzle plate 10 are in close contact with each other.

Likewise, in the head 1 shown in FIG. 9, the substrate 20 and the sealing sheet 30 are bonded (adhered) to each other such that the bonding film 25 formed on the upper surface of the substrate 20 and the bonding film 25 formed on the lower surface of the sealing sheet 30 are in close contact with each other.

Further, the sealing sheet 30 and the vibration plate 40 are bonded (adhered) to each other such that the bonding film 35 formed on the upper surface of the sealing sheet 30 and the bonding film 35 formed on the lower surface of the vibration plate 40 are in close contact with each other.

Further, the vibration plate 40 and the piezoelectric element 50 are bonded (adhered) to each other such that the bonding film 45*a* formed on the upper surface of the vibration plate 40 and the bonding film 45*a* formed on the lower surface of the piezoelectric element 50 are in close contact with each other.

Further, the vibration plate 40 and the case head 60 are bonded (adhered) to each other such that the bonding film 45*b* formed on the upper surface of the vibration plate 40 and the bonding film 45*b* formed on the lower surface of the case head 60 are in close contact with each other.

According to the head 1 having such a structure, the respective members can be particularly firmly bonded to each other at the interfaces. Further, in such ahead 1, the material of an adherend (such as a substrate, a nozzle plate, a sealing sheet, a vibration plate, a piezoelectric element, or a case head) has little effect on the bonding strength, and therefore, the head 1 having high reliability in which the respective members are firmly bonded to one another is obtained regardless of the material of the adherend.

Incidentally, in this case, the application of energy to, for example, the bonding film 15 may be performed for both of the bonding film 15 formed on the lower surface of the substrate 20 and the bonding film 15 formed on the upper surface of the nozzle plate 10.

Further, such a head 1 is preferably used for ejecting the liquid material 31 to be used in the invention.

Here, the liquid material 31 is a liquid material containing the epoxy-modified silicone material and a solvent (dispersion medium) for dissolving or dispersing this epoxy-modified silicone material as described above. Such a solvent may alter or deteriorate a resin material, and therefore, an adhesive which comes into contact with the liquid material 31 cannot maintain the bonding property for a long period of time. For this reason, in the case where the liquid material 31 was ejected by an ink jet method, the adhesive used in the head was altered or deteriorated, and therefore, there was a problem in the durability of the head in the past.

On the other hand, when the liquid droplet ejection head according to the invention is used as the head for ejecting the liquid material 31, alteration or deterioration of the adhesive as described above is not caused, and therefore, the head 1 which exhibits excellent durability for a long period of time is obtained. That is, the head 1 is particularly preferably used for ejecting the liquid material 31.

Incidentally, as described above, as the liquid material 31, a material containing the epoxy-modified silicone material and toluene or xylene as the solvent for dissolving this epoxy-modified silicone material is preferably used. However, such a preferred solvent is highly corrosive to a resin material and may deteriorate the durability of the head.

On the other hand, the liquid droplet ejection head according to the invention can stably store and eject also a liquid material containing a solvent which is highly corrosive to a resin material such as toluene or xylene. Also from this viewpoint, the liquid droplet ejection head according to the invention can be particularly preferably used for ejecting the liquid material 31.

Second Embodiment

Subsequently, a description will be made of a second embodiment in which a liquid droplet ejection head according to the invention is applied to an ink jet type recording head.

Figure 10:
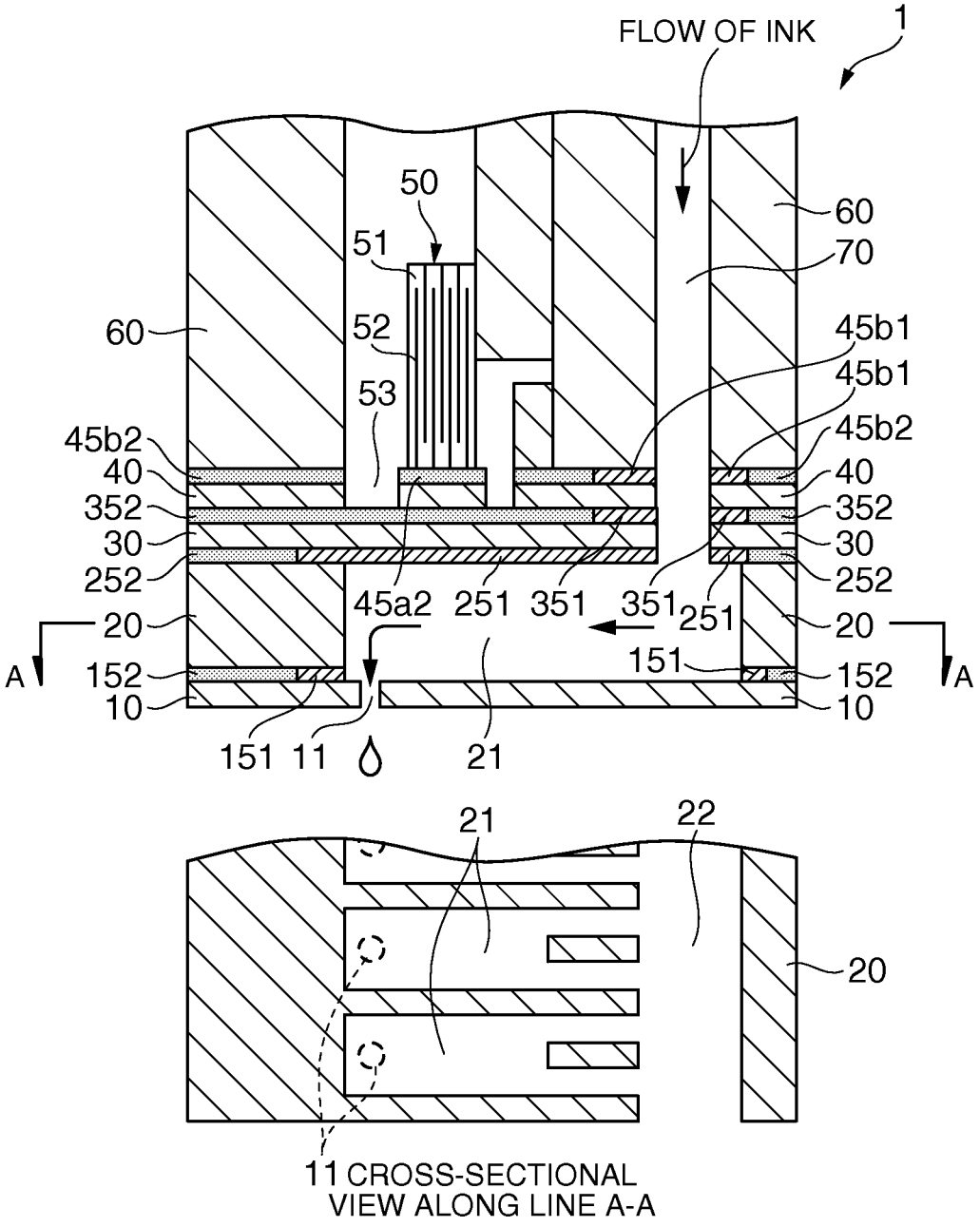
FIG. 10 is a cross-sectional view showing a second embodiment in which a liquid droplet ejection head according to the invention is applied to an ink jet type recording head.

FIG. 10 is a cross-sectional view showing a second embodiment in which a liquid droplet ejection head according to the invention is applied to an ink jet type recording head. In the following description, the upper side of FIG. 10 is referred to as "upper" and the lower side thereof is referred to as "lower" for convenience of explanation.

Hereinafter, the second embodiment of the liquid droplet ejection head will be described, however, the points different from the liquid droplet ejection head according to the first embodiment will be mainly described and descriptions of the same matters will be omitted.

The liquid droplet ejection head according to this embodiment is the same as that of the first embodiment except that the structures of the bond parts between the respective members are different.

That is, the ink jet type recording head 1 shown in FIG. 10 is provided with a nozzle plate 10, a substrate 20, a sealing sheet 30, a vibration plate 40, a piezoelectric element 50, and a case head 60 in the same manner as the first embodiment.

Here, in a bond region between the nozzle plate 10 and the substrate 20, a region on a side of an ejection liquid storage chamber 21 is bonded through a bonding film 151 having a structure similar to (or the same as) that of the bonding film 15. On the other hand, in the bond region between the nozzle plate 10 and the substrate 20, a region on an opposite side from the ejection liquid storage chamber 21 is adhered through an adhesive film 152.

Further, in a bond region between the substrate 20 and the sealing sheet 30, a region on a side of the ejection liquid storage chamber 21 is bonded through a bonding film 251 having a structure similar to that of the bonding film 25. On the other hand, in the bond region between the substrate 20 and the sealing sheet 30, a region on an opposite side from the ejection liquid storage chamber 21 is adhered through an adhesive film 252.

Further, in a bond region between the sealing sheet 30 and the vibration plate 40, a region on a side of a reservoir 70 is bonded through a bonding film 351 having a structure similar to that of the bonding film 35. On the other hand, in the bond region between the sealing sheet 30 and the vibration plate 40, a region on an opposite side from the reservoir 70 is adhered through an adhesive film 352.

Further, the vibration plate 40 and the piezoelectric element 50 are adhered to each other through an adhesive film 45*a*2.

Further, in a bond region between the vibration plate 40 and the case head 60, a region on a side of the reservoir 70 is bonded through a bonding film 45*b*1 having a structure similar to that of the bonding film 45*b*. On the other hand, in the bond region between the vibration plate 40 and the case head 60, a region on an opposite side from the reservoir 70 is adhered through an adhesive film 45*b*2.

In the head 1 having such a structure, the regions on the side of the ejection liquid storage chamber 21 and the reservoir 70 in which the ink is stored in the bond regions of the respective members are bonded through the bonding films similar to the bonding films 15, 25, 35, and 45*b* according to the first embodiment, respectively. Therefore, the respective bond regions exhibit excellent durability against the ink and the like, and an action or effect similar to that of the head 1 according to the first embodiment is obtained.

Further, in this embodiment, the regions on the opposite side from the ejection liquid storage chamber 21 and the reservoir 70 in the bond regions of the respective members are adhered through the respective adhesive films. An adhesive has an advantage that the viscosity before being cured is high and the handling thereof is easy, however, it has low durability against the ink. However, in the head 1 according to this embodiment, each of the adhesive films is not exposed to the ink, and therefore, the disadvantage of the adhesive described above is prevented. Further, since the viscosity of the adhesive is high, the respective members constituting the head 1 can be temporarily fixed.

That is, in the head 1 according to this embodiment, partial regions of the bond regions of the respective members including the nozzle plate 10, the substrate 20, the sealing sheet 30, the vibration plate 40, the piezoelectric element 50, and the case head 60 are temporarily fixed (or are fixed) with the adhesive in advance, and the residual regions are bonded through the bonding films having a structure similar to that in the first embodiment. According to this method, since displacement of the position is not caused in the temporarily fixed regions in advance, the head 1 can be easily and efficiently produced.

Hereinafter, a method of producing the head 1 according to this embodiment will be described.

(1) First, the nozzle plate 10, the substrate 20, the sealing sheet 30, the vibration plate 40, the piezoelectric element 50, and the case head 60 are prepared. Then, the regions on the opposite side from the ejection liquid storage chamber 21 and the reservoir 70 in the bond regions of the respective members, in other words, the regions which are not exposed to the ink are temporarily fixed with the adhesive. By doing this, the above-mentioned adhesive films 152, 252, 352, 45*a*2, and 45*b*2 are obtained. Incidentally, in each of the regions which are not temporarily fixed with the adhesive films 152, 252, 352, 45*a*2, and 45*b*2 in the bond regions of the respective members, a gap with a distance corresponding to the thickness of each of the adhesive films is generated.

As the adhesive, for example, any of various adhesives such as an epoxy-based adhesive, a urethane-based adhesive, or a silicone-based adhesive can be used.

(2) Subsequently, the liquid material 31 is supplied and filled in the reservoir 70 and the ejection liquid storage chamber 21 in the temporarily fixed head 1. By doing this, the liquid material 31 penetrates into the gaps generated in the bond regions of the respective members and is filled in the gaps. Incidentally, this phenomenon in which the liquid material penetrates into the gaps occurs by utilizing the capillary phenomenon, and therefore, by merely storing the liquid material 31 in the reservoir 70 and the ejection liquid storage chamber 21, the gaps can be easily and reliably filled with the liquid material 31. Further, the capillary phenomenon occurs more easily as the distance of the gap is decreased, and therefore, it is preferred that the thickness of each of the adhesive films 152, 252, 352, 45*a*2, and 45*b*2 is as small as possible.

(3) Subsequently, in the same manner as the first embodiment, the liquid material 31 penetrating into the gaps is dried and/or cured. By doing this, the above-mentioned bonding films 151, 251, 351, and 45*b*1 are obtained.

(4) Subsequently, energy is applied to each of the bonding films 151, 251, 351, and 45*b*1. By doing this, each of the bonding films 151, 251, 351, and 45*b*1 exhibits an adhesive property and the respective members of the head 1 are bonded to one another.

The head 1 is obtained as described above.

In this manner, in the case of the head 1 according to this embodiment, a plurality of the bonding films 151, 251, 351, and 45*b*1 can be formed at a time while maintaining excellent durability against the ink, and therefore, the production process can be significantly simplified.

Further, during operation of the head 1, the liquid material 31 is always in contact with the bond regions of the respective members. Therefore, even if peeling or a crack occurs in the bond regions, the liquid material 31 can promptly penetrate into the region where the peeling or crack occurred. Therefore, there is also an advantage that by routinely subjecting the head 1 in such a state to the treatments described in the above steps (3) and (4), the head 1 can be easily repaired.

Incidentally, among the adhesive films 152, 252, 352, 45*a*2, and 45*b*2, at least one adhesive film may be replaced by any of various bonding films other than the adhesive film. Examples of such various bonding films include a plasma polymerization film, a CVD film, and a PVD film.

Hereinabove, the liquid droplet ejection head and the liquid droplet ejection apparatus according to the invention are described with reference to the embodiments shown in the drawings, however, the invention is not limited thereto.

For example, the method of producing the liquid droplet ejection head according to the invention is not limited to the configurations of the above embodiments, and the order of the steps may be altered. Further, one or more steps for an arbitrary purpose may be added, and unnecessary steps may be omitted.

EXAMPLES

Hereinafter, specific examples of the invention will be described.

1. Production of Ink Jet Type Recording Head

Example 1

(1) First, a nozzle plate made of stainless steel, a plate-shaped base material made of monocrystalline silicon, a sealing sheet made of a polyphenylene sulfide resin (PPS), a vibration plate made of stainless steel, a piezoelectric element formed of a laminated body of a piezoelectric layer composed of a sintered body of lead zirconate and an electrode film formed by sintering an Ag paste, and a case head made of PPS were prepared.

Subsequently, the base material was subjected to a surface treatment using oxygen plasma.

Subsequently, an epoxy-modified silicone material ("TSR-194", manufactured by Momentive Performance Materials Japan LLC.) was prepared and supplied onto the base material by an ink jet method. By doing this, a liquid coating film was formed on the base material.

Subsequently, this liquid coating film was dried and/or cured by heating the film at 200° C. for 1 hour, whereby a bonding film having an average thickness of 10 μm was formed on the base material.

Subsequently, the thus obtained bonding film was brought into contact with plasma under the conditions shown below using an atmospheric pressure plasma device shown in FIG. 8. By doing this, the bonding film was activated and allowed to exhibit a bonding property on its surface.

Conditions for Plasma Treatment

Treatment gas: Mixed gas of helium gas and oxygen gas
Gas supply rate: 10 SLM
Distance between electrodes: 1 mm
Applied voltage: 1 kVp-p
Frequency of voltage: 40 MHz
Moving speed: 1 mm/sec On the other hand, one surface of the sealing sheet was subjected to a surface treatment using oxygen plasma.

Subsequently, the base material and the sealing sheet were bonded to each other such that the surface of the bonding film brought into contact with plasma and the surface of the sealing sheet subjected to the surface treatment came into contact with each other. By doing this, a bonded body of the base material and the sealing sheet was obtained.

(2) Subsequently, a bonding film was formed on the sealing sheet of the bonded body of the base material and the sealing sheet in the same manner as the above step (1).

Subsequently, the resulting bonding film was brought into contact with plasma in the same manner as in the above step (1). On the other hand, one surface of the vibration plate was subjected to a surface treatment using oxygen plasma.

Then, the bonded body and the vibration plate were bonded to each other such that the surface of the bonding film brought into contact with plasma and the surface of the vibration plate subjected to the surface treatment came into contact with each other. By doing this, a bonded body of the base material, the sealing sheet, and the vibration plate was obtained.

(3) Subsequently, a through-hole was formed in the sealing sheet, the vibration plate, and the polymerized film adjacent to these members at a position where an ejection liquid supply chamber of the head was to be formed. Further, a through-hole was formed in an annular shape so as to surround a region where the piezoelectric element was mounted in the vibration plate. Incidentally, these through-holes were formed by an etching method, respectively.

(4) Subsequently, a bonding film was formed in the same manner as in the above step (1) at a position (a region in an inside of the annular through-hole) where the piezoelectric element was mounted in the vibration plate of the bonded body of the base material, the sealing sheet, and the vibration plate.

Subsequently, the resulting bonding film was brought into contact with plasma in the same manner as in the above step (1). On the other hand, one surface of the piezoelectric element was subjected to a surface treatment using oxygen plasma.

Then, the bonded body and the piezoelectric element were bonded to each other such that the surface of the bonding film brought into contact with plasma and the surface of the piezoelectric element subjected to the surface treatment came into contact with each other. By doing this, a bonded body of the base material, the sealing sheet, the vibration plate, and the piezoelectric element was obtained.

(5) Subsequently, a bonding film was formed in the same manner as in the above step (1) at a position where the case head was mounted in the bonded body of the base material, the sealing sheet, the vibration plate, and the piezoelectric element.

Subsequently, the resulting bonding film was brought into contact with plasma in the same manner as in the above step (1). On the other hand, a surface of the case head to be bonded was subjected to a surface treatment using oxygen plasma.

Then, the bonded body and the case head were bonded to each other such that the surface of the bonding film brought into contact with plasma and the surface of the case head subjected to the surface treatment came into contact with each other. By doing this, a bonded body of the base material, the sealing sheet, the vibration plate, the piezoelectric element, and the case head was obtained.

(6) Subsequently, the thus obtained bonded body was turned upside down and a surface of the base material on an opposite side from the surface to which the sealing sheet of the base material was bonded was processed by an etching method. Then, an ejection liquid storage chamber and an ejection liquid supply chamber were formed in the base material, whereby an ejection liquid storage chamber forming substrate was obtained.

(7) Subsequently, a bonding film was formed on the ejection liquid storage chamber forming substrate in the same manner as in the above step (1).

Subsequently, the resulting bonding film was brought into contact with plasma in the same manner as in the above step (1). On the other hand, a surface of the nozzle plate to be bonded was subjected to a surface treatment using oxygen plasma.

Then, the ejection liquid storage chamber forming substrate and the nozzle plate were bonded to each other such that the surface of the bonding film brought into contact with plasma and the surface of the nozzle plate subjected to the surface treatment came into contact with each other. By doing this, a bonded body of the nozzle plate, the base material, the sealing sheet, the vibration plate, the piezoelectric element, and the case head, that is, an ink jet type recording head was obtained.

(8) Subsequently, the thus obtained ink jet type recording head was heated at 80° C. for 15 minutes while compressing it at a pressure of 3 MPa. By doing this, the bonding strength of the ink jet type recording head was increased.

Example 2

An ink jet type recording head was produced in the same manner as in the above Example 1 except that bonding films were formed on both sides of each of the bond interfaces and the bonding films were bonded to each other.

Specifically, first, a bonding film was formed on the base material in the same manner as in the above Example 1.

Further, a bonding film was formed also on the sealing sheet in the same manner.

Subsequently, the bonding film on the base material and the bonding film on the sealing sheet were brought into contact with plasma, respectively.

Subsequently, the base material and the sealing sheet were bonded to each other such that the respective bonding films were in close contact with each other, whereby bonding between the base material and the sealing sheet was achieved.

Further, bonding was achieved in the same manner as above between the sealing sheet and the vibration plate, between the vibration plate and the piezoelectric element, between the vibration plate and the case head, and between the ejection liquid storage chamber forming substrate and the nozzle plate, respectively.

Comparative Example 1

An ink jet type recording head was produced in the same manner as in the above Example 1 except that all the bond parts, namely, the respective bond parts between the nozzle plate and the ejection liquid storage chamber forming substrate, between the base material and the sealing sheet, between the sealing sheet and the vibration plate, between the vibration plate and the piezoelectric element, and between the vibration plate and the case head were bonded with an epoxy adhesive.

Comparative Example 2

An ink jet type recording head was produced in the same manner as in the above Example 1 except that all the bond parts, namely, the respective bond parts between the nozzle plate and the ejection liquid storage chamber forming substrate, between the base material and the sealing sheet, between the sealing sheet and the vibration plate, between the vibration plate and the piezoelectric element, and between the vibration plate and the case head were bonded with a silicone material ("KR-251", manufactured by Shin-Etsu Chemical Co., Ltd.) having no epoxy resin in place of the epoxy-modified silicone material.

2. Evaluation of Ink Jet Type Recording Head 2.1 Evaluation of Dimensional Accuracy The dimensional accuracy was measured for each of the inkjet type recording heads obtained in the respective Examples and Comparative Examples.

As a result, the dimensional accuracy of each of the inkjet type recording heads obtained in the respective Examples and Comparative Example 2 was higher than that of the ink jet type recording head obtained in Comparative Example 1.

Further, each of the ink jet type recording heads was mounted on an ink jet printer, and printing was performed on a sheet of printing paper. As a result, it was confirmed that the printer on which each of the heads obtained in the respective Examples was mounted exhibited a higher printing quality than the printer on which each of the heads obtained in Comparative Examples was mounted.

2.2 Evaluation of Chemical Resistance

Each of the ink jet type recording heads obtained in the respective Examples and Comparative Examples was filled with N-methylpyrrolidone (NMP, 100%) as an organic solvent and was left as such for 80 hours. Thereafter, the state of each of the ink jet type recording heads was evaluated.

As a result, almost no penetration of NMP into the bond parts was observed in the ink jet type recording heads obtained in the respective Examples. On the other hand, penetration of NMP into the bond parts was observed in the ink jet type recording heads obtained in the respective Comparative Examples. In particular, this penetration of NMP into the bond parts was significantly observed in the ink jet type recording head obtained in Comparative Example 1.

Also in the case where each of the ink jet type recording heads obtained in the respective Examples and Comparative Examples was filled with the epoxy-modified silicone material ("TSR-194", manufactured by Momentive Performance Materials Japan LLC.) in place of NMP, and was left as such for 3 weeks, the same results as those in the case of NMP were obtained.

What is claimed is:

1. A liquid droplet ejection head, comprising:

a substrate having a first surface and a second surface, a nozzle plate positioned relative to the first surface of the substrate, the nozzle plate having nozzles through which an ejection liquid is ejected in the form of liquid droplets, and a sealing plate;

a sealing plate positioned relative to the second surface of the substrate; and a bonding film disposed on one of the substrate, the nozzle plate, and the sealing plate, wherein the bonding film has a bonding property exhibited in a coating film containing an epoxy-modified silicone material through the application of energy to the coating film, the epoxy-modified silicone material is obtained by an addition reaction between a silicone material and an epoxy resin, and the epoxy resin has a phenylene group in each molecule.

2. The liquid droplet ejection head according to claim 1, wherein the silicone material is composed of polydimethylsiloxane as a main backbone, and the main backbone is branched.

3. The liquid droplet ejection head according to claim 2, wherein, in the silicone material, at least one methyl group of the polydimethylsiloxane has been substituted by a phenyl group.

4. The liquid droplet ejection head according to claim 1, wherein the silicone material has a plurality of silanol groups.

5. The liquid droplet ejection head according to claim 1, wherein the epoxy resin has a linear molecular structure.

6. The liquid droplet ejection head according to claim 1, wherein a partial region of a bond region to be bonded through the bonding film is fixed with an adhesive in advance, and the bonding film bonds a region other than the partial region of the bond region.

7. The liquid droplet ejection head according to claim 6, wherein the bonding film which bonds a region other than the partial region of the bond region is formed by supplying a liquid material containing the epoxy-modified silicone material to the ejection liquid storage chamber formed by the fixing to allow the liquid material to penetrate into an outer portion of the bond region thereby forming a coating film of the liquid material, and then, drying and/or curing the coating film, followed by applying energy to the coating film.

8. The liquid droplet ejection head according to claim 1, wherein the bonding film has an average thickness of 10 to 10000 nm.

9. The liquid droplet ejection head according to claim 1, wherein at least a portion of the substrate, the nozzle plate, or the sealing plate, which comes into contact with the bonding film, is mainly made of a silicon material, a metal material, or a glass material.

10. The liquid droplet ejection head according to claim 1, wherein a surface of the substrate, the nozzle plate, or the sealing plate, which comes into contact with the bonding film, is subjected to a surface treatment for increasing an adhesive property with the bonding film in advance.

11. The liquid droplet ejection head according to claim 10, wherein the surface treatment is a plasma treatment or an ultraviolet irradiation treatment.

12. The liquid droplet ejection head according to claim 1, wherein the application of energy is performed by at least one of a method of irradiating the bonding film with an energy ray and a method of bringing the bonding film into contact with plasma.

13. The liquid droplet ejection head according to claim 12, wherein the energy ray is an ultraviolet ray having a wavelength of 126 to 300 nm.

14. The liquid droplet ejection head according to claim 1, wherein the application of energy is performed in an air atmosphere.

15. The liquid droplet ejection head according to claim 1, wherein after bonding the substrate to at least one of the nozzle plate and the sealing plate through the bonding film, a treatment for increasing the bonding strength is further performed for the bonding film.

16. The liquid droplet ejection head according to claim 15, wherein the treatment for increasing the bonding strength is performed by at least one of a method of heating the bonding film and a method of applying a compressive force to the bonding film.

17. The liquid droplet ejection head according to claim 1, wherein the sealing plate is formed of a laminated body having a plurality of layers laminated on one another, and bonding is achieved through a bonding film similar to the bonding film between at least one pair of adjacent layers among the layers in the laminated body.

18. The liquid droplet ejection head according to claim 1, further comprising:

a vibration unit which is provided on an opposite side of the sealing plate from the substrate and vibrates the sealing plate, wherein the sealing plate and the vibration unit are bonded to each other through a bonding film similar to the bonding film.

19. The liquid droplet ejection head according to claim 18, wherein the vibration unit is formed of a piezoelectric element.

20. The liquid droplet ejection head according to claim 1, further comprising:

a case head which is provided on an opposite side of the sealing plate from the substrate, wherein the sealing plate and the case head are bonded to each other through a bonding film similar to the bonding film.

21. A liquid droplet ejection apparatus, comprising the liquid droplet ejection head according to claim 1.

* * * * *